US010815660B2

(12) United States Patent
Tremblay

(10) Patent No.: US 10,815,660 B2
(45) Date of Patent: Oct. 27, 2020

(54) STRUCTURAL PANEL ASSEMBLY FOR MOUNTING BUILDING WALLS AND METHOD FOR MOUNTING BUILDING WALLS USING SAME

(71) Applicant: OSBLOCK INC., Sainte-Monique, Québec (CA)

(72) Inventor: Marco Tremblay, Quebec (CA)

(73) Assignee: OSBLOCK INC., Sainte-Monique, Québec (CA)

( * ) Notice: Subject to any disclaimer, the term of this patent is extended or adjusted under 35 U.S.C. 154(b) by 0 days.

(21) Appl. No.: 16/334,298

(22) PCT Filed: Sep. 15, 2017

(86) PCT No.: PCT/CA2017/051089
§ 371 (c)(1),
(2) Date: Mar. 18, 2019

(87) PCT Pub. No.: WO2018/049529
PCT Pub. Date: Mar. 22, 2018

(65) Prior Publication Data

US 2019/0218772 A1 Jul. 18, 2019

Related U.S. Application Data

(60) Provisional application No. 62/395,574, filed on Sep. 16, 2016.

(51) Int. Cl.
*E04B 2/08* (2006.01)
*E04C 2/296* (2006.01)
(Continued)

(52) U.S. Cl.
CPC ..... *E04B 2/08* (2013.01); *E04C 2/284* (2013.01); *E04C 2/296* (2013.01);
(Continued)

(58) Field of Classification Search
CPC ..... E04B 2/08; E04B 2002/0206; E04B 2002/0243; E04B 2002/025;
(Continued)

(56) References Cited

U.S. PATENT DOCUMENTS 2,732,706 A 1/1956 Friedman
3,566,561 A * 3/1971 Tozer ..... A47B 96/1466 52/127.12
(Continued)

FOREIGN PATENT DOCUMENTS

CA 2040926 C 10/1992
DE 29502850 U1 4/1995
(Continued)

OTHER PUBLICATIONS

CIPO; PCT/CA2017/051089; International Search Report dated Dec. 7, 2017.

*Primary Examiner* — Rodney Mintz
(74) *Attorney, Agent, or Firm* — Fitch, Even, Tabin & Flannery LLP

(57) ABSTRACT

A structural panel having a structural inner core with a male member and a female member. The female member is configured to receive the male member of a vertically adjacent panel therein and has a locking slot. The structural panel also includes a locking member operatively engageable to the male member and configurable between an unlocked configuration where it does not substantially project outside of lateral wall surfaces of the male member and a locked configuration where it projects outside of at least one of the lateral wall surfaces of the male member and is engaged in the locking slot of the vertically adjacent panel. A panel assembly, a method for building a building wall using multiple structural panels, a corner securement assembly for at least two horizontally adjacent structural panels
(Continued)

and a method for securing two horizontally adjacent panels in a corner configuration are also provided.

20 Claims, 21 Drawing Sheets

(51) Int. Cl.
*E04C 2/284* (2006.01)
*E04B 2/02* (2006.01)

(52) U.S. Cl.
CPC . *E04B 2002/025* (2013.01); *E04B 2002/0206* (2013.01); *E04B 2002/0243* (2013.01); *E04B 2002/0256* (2013.01)

(58) Field of Classification Search
CPC .. E04B 2002/0256; E04B 2/766; E04C 2/296; E04C 2/284
See application file for complete search history.

(56) References Cited

U.S. PATENT DOCUMENTS 3,936,987 A 2/1976 Calvin
4,439,971 A 4/1984 Rutherford
5,155,960 A 10/1992 Shaanan
5,163,259 A 11/1992 Hunsaker et al.
5,424,118 A 6/1995 McLaughlin
5,634,300 A * 6/1997 Huebner ..... E04B 2/7407 52/281
6,235,367 B1 5/2001 Holmes et al.
6,434,890 B1 * 8/2002 Konnerth ..... E04B 2/7401 52/169.5
6,564,521 B1 * 5/2003 Brown ..... E04C 2/292 52/309.11
6,907,704 B2 6/2005 Abang Ali et al.
7,546,712 B2 6/2009 Shaw
7,841,145 B2 11/2010 Pervan et al.
8,464,482 B2 6/2013 Raynor
9,181,712 B2 11/2015 Laufer et al.
9,212,485 B2 12/2015 Wolynski et al.
9,328,752 B2 * 5/2016 Emanuel ..... F16B 2/20
2007/0094989 A1 5/2007 Scheker
2008/0184649 A1 8/2008 Khan
2010/0269439 A1 * 10/2010 Morrisette ..... E04B 1/80 52/309.4
2011/0173911 A1 7/2011 Propst
2011/0192107 A1 8/2011 Farquhar
2012/0324820 A1 12/2012 Drew
2013/0312357 A1 11/2013 Lin
2014/0090325 A1 4/2014 Maeers
2014/0150361 A1 6/2014 Castonguay et al.
2014/0196397 A1 7/2014 Sourlis et al.
2015/0047281 A1 2/2015 Cole et al.
2015/0218805 A1 8/2015 Jensen
2015/0247328 A1 9/2015 Correia et al.
2015/0252572 A1 9/2015 Bauer et al.
2017/0121961 A1 * 5/2017 Hodson ..... E04H 1/005

FOREIGN PATENT DOCUMENTS

EP 2775056 A1 9/2014
FR 2445461 A3 7/1980
FR 2510680 A1 2/1983
FR 2579879 A1 10/1986
JP 2000213143 A 8/2000
WO 2013105073 A1 7/2013

* cited by examiner

STRUCTURAL PANEL ASSEMBLY FOR MOUNTING BUILDING WALLS AND METHOD FOR MOUNTING BUILDING WALLS USING SAME

CROSS-REFERENCE TO RELATED APPLICATIONS

This application is a U.S. national phase application filed under 35 U.S.C. § 371 of international Application No. PCT/CA2017/051089, filed Sep. 15, 2017, designating the United States, which claims benefit from U.S. Provisional Application No. 62/395,574, filed Sep. 16, 2016, the entire contents of which are incorporated herein by reference.

FIELD OF THE INVENTION

The present invention relates to the field of modular construction assemblies. More particularly, it relates to a structural panel assembly for mounting structural and insulated building walls and to a method for mounting structural and insulated building walls using the structural panel assembly.

Background of the Invention

It is known in the art to erect wall structures of buildings using conventional wall construction techniques, such as the securing of frame components to one another and placement of isolation in the cavities defined therebetween in order to produce structural insulating walls. Conventional wall construction techniques are however time-consuming and generally require a substantial amount of field labor, specialized tools and/or manual skills. Moreover, the mobilizing of fabrication resources on site is generally expensive and it can also be difficult to ensure a consistent level of quality as the overall work quality is highly dependent on the skills of the workers involved.

In view of the above, prefabrication of building components, such as trusses and walls, is well known in the art to reduce some of the above-mentioned concerns inherent to conventional on-site construction of building structure. Construction using known standardized, prefabricated components, however, continues to suffer from substantial limitations. Indeed, installation of known standardized, prefabricated components, can often also be time-consuming and require substantial field labor, specialized tools and/or manual skills.

In view of the above, there is a need for an improved structural panel assembly for mounting building walls and to a method for mounting building walls using the structural panel assembly which would be able to overcome or at least minimize some of the above-discussed prior art concerns.

SUMMARY OF THE INVENTION

In accordance with a first general aspect, there is provided a structural panel. The structural panel comprises a structural inner core and a vertical locking mechanism allowing locking of the structural panel to a vertically adjacent structural panel. The vertical locking mechanism comprises a male member projecting outwardly at one of an upper end and a lower end of the structural inner core of the structural panel. The male member has lateral wall surfaces. The vertical locking mechanism also comprises a female member defined in the structural inner core of the structural panel and being positioned at the other one of the upper end and the lower end of the structural panel. The female member is configured to receive the male member of the vertically adjacent structural panel therein and has a locking slot extending laterally further into the structural inner core. The vertical locking mechanism further comprises a locking member operatively engageable to the male member. The locking member has a locking tab and is configurable between an unlocked configuration where the locking tab does not substantially project outside of the lateral wall surfaces of the male member and a locked configuration where the locking tab projects outside of at least one of the lateral wall surfaces of the male member. The locking tab is engageable in the locking slot of the vertically adjacent structural panel when the locking member is configured in the locked configuration.

In an embodiment, the structural panel further comprises a rigid insulating layers positioned on opposed lateral sides of the structural inner core and joined thereto.

In an embodiment, the rigid insulating layers substantially cover the respective surface of the structural inner core on opposite sides thereof. The rigid insulating layers and the structural inner core have a resulting thermal resistance ranging between about R12 and about R40.

In an embodiment, the rigid insulating layers comprise polystyrene material.

In an embodiment, the rigid insulating layers have an external surface and the structural panel further comprises longitudinally extending laths joined to the external surface of a respective one of the rigid insulating layers.

In an embodiment, the rigid insulating layers comprise at least one vertically extending recess defined therein. The at least one vertically extending recess is sized and shaped to allow the passage of utility members therein.

In an embodiment, the locking member comprises a tool engagement channel defined therein.

In an embodiment, the structural inner core comprises a locking aperture extending therethrough. The locking aperture is substantially in register with the tool engagement channel of the locking member engaged to the male member and allows engagement of the locking member, through the structural inner core of the structural panel, for moving the locking member between the unlocked configuration and the locked configuration.

In an embodiment, the locking member comprises a stem and the tool engagement channel has an inlet, the inlet being inwardly bevelled and being configured to help guiding a rotative tool towards the tool engagement channel.

In an embodiment, the locking tab of the locking member comprises at least one bevelled corner section.

In an embodiment, the structural panel comprises a plurality of locking members operatively engageable to the male member and spaced apart from one another along a longitudinal axis of the panel.

In an embodiment, the structural inner core comprises an oriented strand board material.

In an embodiment, each one of the male member and the female member of the vertical locking mechanism extends continuously along the structural panel.

In an embodiment, the locking slot is positioned at an inner end of the female member.

In an embodiment, there is also provided a structural panel assembly comprising a plurality of the above-described structural panels, engaged and secured to one another to define a wall. The wall has a bottom end and a top end. The structural panel assembly further comprises a bottom end cap and an upper end cap configured to engage with a structural panel respectively at the bottom end of the wall and at the upper end of the wall.

In an embodiment, the bottom end cap comprises one of a male member projecting outwardly therefrom and having lateral wall surfaces and a female member configured to receive the male member of a vertically adjacent structural panel therein and having a locking slot extending laterally further into the bottom end.

In accordance with another general aspect, there is also provided a method for building a building wall using multiple structural panels. The method comprises: engaging two vertically adjacent ones of the structural panels together by inserting a male member of a first one of the two vertically adjacent structural panels into a female member of a second one of the two vertically adjacent structural panels, with a locking member operatively connected to the male member of the first one of the two vertically adjacent structural panels configured in an unlocked configuration; and vertically locking the two vertically adjacent panels together by configuring the locking member into a locked configuration, the locking member comprising a locking tab being inserted in a locking slot of the female member of the second one of the two vertically adjacent structural panels when the locking member is configured in the locked configuration.

In an embodiment, the step of vertically locking the first panel to the second vertically adjacent panel includes engaging the locking member through a locking aperture defined in a structural inner core of the first panel.

In an embodiment, the step of vertically locking the first panel to the second vertically adjacent panel includes rotating the locking member from the unlocked configuration to the locked configuration.

In an embodiment, the step of rotating the locking member from the unlocked configuration to the locked configuration includes engaging a section of a rotative tool in the locking aperture defined in the structural inner core of the first panel; inserting a section of the rotative tool in a tool engagement channel of the locking member; and rotating the rotative tool to rotate the locking member from the unlocked configuration to the locked configuration.

In an embodiment, the method further comprises the initial steps of: engaging a first structural panel to a bottom end cap by inserting a male member of one of the first panel and the bottom end cap into a female member of the other one of the first panel and the bottom end cap, with a locking member operatively connected to the male member of the corresponding one of the first panel and the bottom end cap configured in an unlocked configuration; and vertically locking the first panel and the bottom end cap together by configuring the locking member into a locked configuration, the locking member comprising a locking tab being inserted in a locking slot of the female member of the corresponding one of the first panel and the bottom end cap when the locking member is configured in the locked configuration.

In accordance with another general aspect, there is further provided a corner securement assembly for a structural panel assembly comprising at least two horizontally adjacent structural panels. The corner securement assembly comprises a vertically extending securement anchor comprising a first securement plate and a second securement plate; and securing brackets each having an engagement section horizontally interlockable to a corresponding one of the first securement plate and the second securement plate of the securement anchor and a fastening section fastenable to a corresponding one of the at least two horizontally adjacent panels.

In an embodiment, the two horizontally adjacent structural panels each have a structural inner core and the fastening section of each one of the securing brackets is securable to the structural inner core of the corresponding one of the at least two horizontally adjacent panels.

In an embodiment, each one of the first securement plate and the second securement plate of the securement anchor comprises at least one bracket engagement aperture and the engagement section of each one of the securing brackets is sized and shaped to be at least partially insertable through a corresponding one of the at least one bracket engagement aperture when the securing bracket is oriented in an insertion orientation and at least partially prevented from moving through the engagement aperture when the securing bracket is oriented in an interlocked orientation.

In an embodiment, the engagement section of the securing bracket comprises lateral flanges insertable through the corresponding one of the at least one bracket engagement aperture when the securing bracket is oriented in the insertion orientation and prevented from moving through the engagement aperture when the securing bracket is oriented in the interlocked orientation.

In an embodiment, the securement anchor comprises an "L" shaped brace.

In an embodiment, the securement anchor comprises a hinge joining the first securement plate and the second securement plate.

In an embodiment, the securement anchor comprises a structural core post, with the first securement plate and the second securement plate being mounted to adjacent outer surfaces of the structural core post.

In an embodiment, the structural core post comprises vertically extending recess defined therein and positioned rearwardly of the first securement plate and the second securement plate to define a free space for receiving the engagement section of the corresponding securing brackets.

In an embodiment, the securement anchor further comprises an insulation layer covering an external surface of the structural core post.

In an embodiment, the securement anchor further comprises an external structural wall section, the insulation layer being positioned between the external structural wall section and the structural core post.

In an embodiment, the first securement plate and the second securement plate are oriented to define a vertical angle of about 90° therebetween.

In accordance with another general aspect, there is further provided a method for securing two horizontally adjacent panels of a structural panel assembly in a corner configuration. The method comprises: positioning a securement anchor comprising a first securement plate and a second securement plate between the two horizontally adjacent panels; engaging an engagement section of a first securing bracket to the first securement plate of the securement anchor and fastening a fastening section of the first securing bracket to one of the two horizontally adjacent panels; and engaging an engagement section of a second securing bracket to the second securement plate of the securement anchor and fastening the fastening section of the second securing bracket to the other one of the two horizontally adjacent panels.

In an embodiment, the method further comprises: abutting a section of the first securement plate with an end surface of a structural inner core of the one of the two horizontally adjacent panels; and abutting a section of the second securement plate with the end surface of the structural inner core of the other one of the two horizontally adjacent panels.

In an embodiment, the steps of fastening the fastening section of the first securing bracket to the one of the two horizontally adjacent panels and fastening the fastening section of the second securing bracket to the other one of the two horizontally adjacent panels comprise: fastening the fastening section of the first securing bracket to the structural inner core of the one of the two horizontally adjacent panels; and fastening the fastening section of the second securing bracket to the structural inner core of the one of the two horizontally adjacent panels.

In an embodiment, the steps of engaging an engagement section of a first securing bracket to the first securement plate of the securement anchor and engaging an engagement section of a second securing bracket to the second securement plate of the securement anchor further comprises: orienting the first securing bracket in an insertion orientation; inserting at least a portion of the engagement section of the first securing bracket in a bracket engagement aperture of the first securement plate; and orienting the first securing bracket in an interlocked orientation; and orienting the second securing bracket in an insertion orientation; inserting at least a portion of the engagement section of the second securing bracket in a bracket engagement aperture of the second securement plate; and orienting the second securing bracket in an interlocked orientation.

In an embodiment, the steps of orienting the first securing bracket in the interlocked orientation and orienting the second securing bracket in the interlocked orientation comprise rotating the first securing bracket from the insertion orientation to the interlocked orientation and rotating the second securing bracket from the insertion orientation to the interlocked orientation.

BRIEF DESCRIPTION OF THE DRAWINGS

Other objects, advantages and features will become more apparent upon reading the following non-restrictive description of embodiments thereof, given for the purpose of exemplification only, with reference to the accompanying drawings in which:

FIG. 5A' is a close-up perspective view of sections 5A of FIG. 5.

FIG. 5B' is a close-up perspective view of sections 5B' of FIG. 5B.

DETAILED DESCRIPTION OF THE PREFERRED EMBODIMENTS

In the following description, the same numerical references refer to similar elements. The embodiments, geometrical configurations, materials mentioned and/or dimensions shown in the figures or described in the present description are embodiments only, given solely for exemplification purposes.

Although the embodiments of the structural panel assembly and corresponding parts thereof consist of certain geometrical configurations as explained and illustrated herein, not all of these components and geometries are essential and thus should not be taken in their restrictive sense. It is to be understood, as also apparent to a person skilled in the art, that other suitable components and cooperation therein between, as well as other suitable geometrical configurations, may be used for the structural panel assembly, as will be briefly explained herein and as can be easily inferred herefrom by a person skilled in the art. Moreover, it will be appreciated that positional descriptions such as "above", "below", "left", "right" and the like should, unless otherwise indicated, be taken in the context of the figures and should not be considered limiting.

To provide a more concise description, some of the quantitative expressions given herein may be qualified with the term "about". It is understood that whether the term "about" is used explicitly or not, every quantity given herein is meant to refer to an actual given value, and it is also meant to refer to the approximation to such given value that would reasonably be inferred based on the ordinary skill in the art, including approximations due to the experimental and/or measurement conditions for such given value. In other words, in the following description, the term "about" means within an acceptable error range for the particular value as determined by one of ordinary skill in the art, which will depend in part on how the value is measured or determined, i.e. the limitations of the measurement system.

Moreover, although the embodiments comprise particular steps of a method, not all of these steps are essential and thus should not be taken in their restrictive sense. It is to be understood, as also apparent to a person skilled in the art, that other suitable configurations may be used for the method, as will be briefly explained herein and as can be easily inferred herefrom, by a person skilled in the art, without departing from the scope of the invention.

In general terms, the present application is directed to a structural prefabricated panel assembly 10 defined by a plurality of panels 20 engageable and securable to one another with the use of minimal construction tools and construction skills, thereby allowing easy construction of structural building walls.

Figure 1:
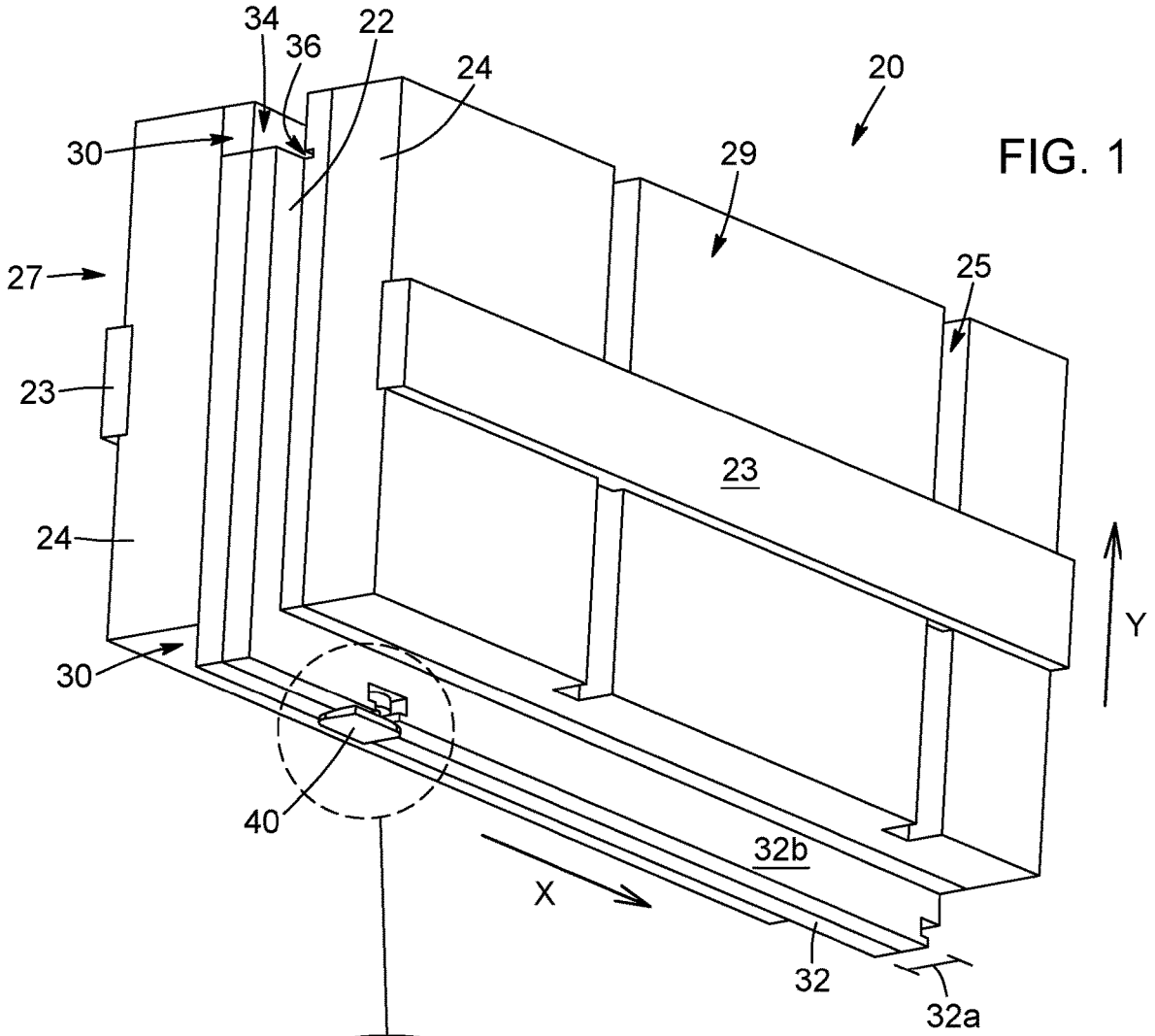
FIG. 1 is a perspective view of a structural panel, in accordance with an embodiment.
Figure 2:
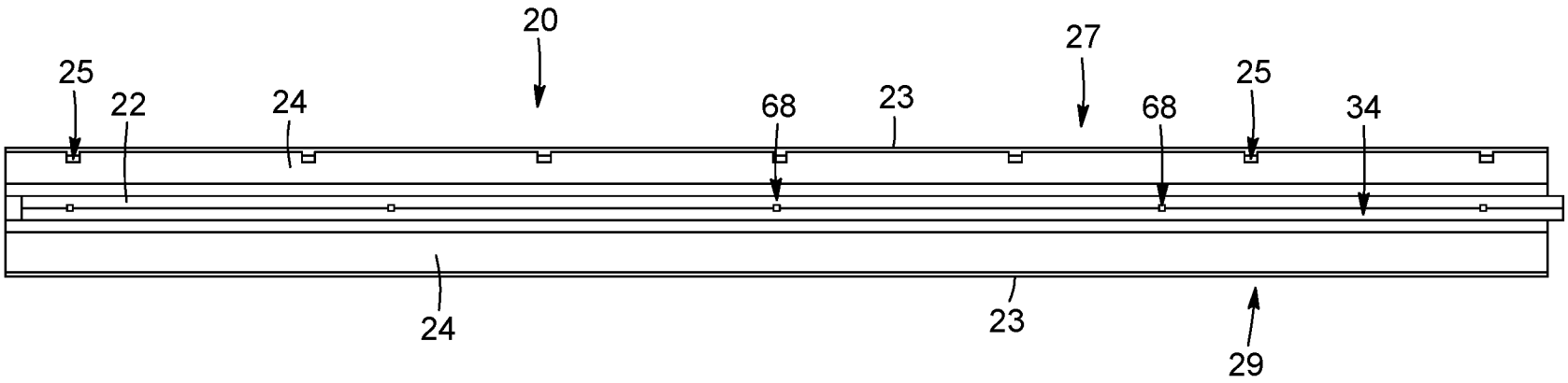
FIG. 2 is a top plan view of the structural panel of FIG. 1.
Figure 3:
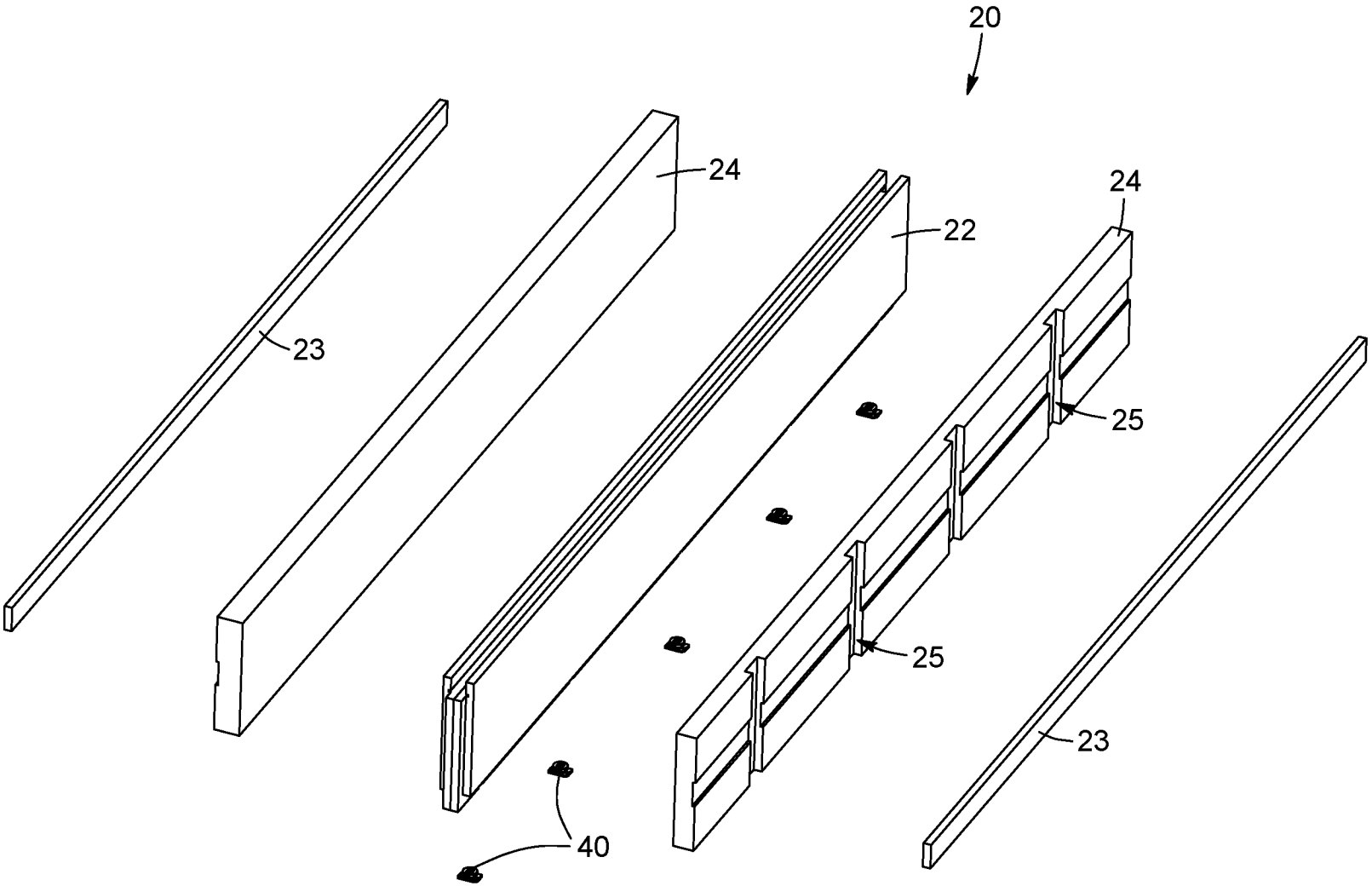
FIG. 3 is an exploded view of the structural panel of FIG. 1.

Referring generally to FIGS. 1 to 3, in accordance with one embodiment, each one of the structural panel 20 includes a structural inner core 22 made of rigid material providing sufficient rigidity, compressive strength and/or tensile strength for the panel 20 to be used as constituent of a structure of a building. For example and without being limitative, in an embodiment, the structural inner core 22 can be made of engineered lumber such as, oriented strand board (OSB). One skilled in the art will however understand that, in alternative embodiments, other rigid materials providing sufficient rigidity, compressive strength and/or tensile strength, such as, for example and without being limitative, wood, plastic, metal or the like, or a combination thereof, can also be used for the structural inner core 22.

In an embodiment, each one of the structural panel 20 also includes rigid insulating layers 24 positioned on opposed lateral sides of the structural inner core 22 and joined (or attached) thereto. In an embodiment, the rigid insulating layers 24 substantially cover the respective surface of the structural inner core 22, on the opposed lateral sides thereof. In an embodiment, the rigid insulating layers 24 and the structural inner core 22 result in the panel 20 having a thermal resistance ranging between about R12 and about R40. For example and without being limitative, in an embodiment, the rigid insulating layers 24 can be made of polystyrene. One skilled in the art will however understand that, in alternative embodiments other rigid insulating materials such as rigid polyurethane, rigid fiberglass or the like, can also be used for the rigid insulating layers 24.

One skilled in the art will understand that, in alternative embodiments (not shown), a rigid insulating layer 24 can be positioned on only one lateral side of the structural inner core 22 and joined (or attached). In another alternative embodiment, no insulating layer 24 can be provided. Moreover, in another alternative embodiment, the rigid insulating layers 24 can include or be replaced by fireproof layers, sound insulation layers, or the like.

In an embodiment, longitudinally extending laths 23 can also be mounted to the corresponding insulating layers 24, on the inner side 27 and outer side 29 of the structural panel 20. The longitudinally extending laths 23 allow the fastening of a corresponding inner/outer covering to a wall 75 built using a plurality of panels 20 engaged to one another, as will be described in more details below. More particularly, the longitudinally extending laths 23 allow the fastening of a corresponding inner/outer covering onto a surface of the wall 75, with the covering being spaced apart from the insulating layer 24. For example and without being limitative, in an embodiment, the longitudinally extending laths 23 can be wooden laths. One skilled in the art will understand that, in alternative embodiments, other materials such as plastic or the like can also be used for the longitudinally extending laths 23.

In the embodiment shown, the longitudinally extending laths 23 are recessed into the corresponding insulating layer 24 (i.e. a section of the longitudinally extending laths 23 is positioned in a corresponding longitudinally extending recess defined in the corresponding insulating layer 24). One skilled in the art will understand that known fastening means or methods can be used to join (or fasten) the longitudinally extending laths 23 to the corresponding insulating layer 24, such as, for example and without being limitative, gluing, nailing, screwing, etc., or a combination thereof.

In an embodiment, each one of the rigid insulating layers 24 further includes at least one vertically extending recess 25 defined on the external surface thereof. In the embodiment shown, a plurality of vertically extending recesses 25 are defined on the external surface of the rigid insulating layers 24 on the inner side 27 and the outer side 29 of the structural panel 20, with the vertically extending recesses 25 extending under the longitudinally extending laths 23 and thereby spanning substantially along the entire height of the rigid insulating layers 24. The vertically extending recesses 25 are sized and shaped to allow the passage of utility members, such as, for example and without being limitative, wires, small pipes or the like therein. In the present description, the term "utility member" refers to longitudinally extending element used for providing a utility service such as electricity, cable, or the like in the corresponding building. For example and without being limitative, the utility members can include electrical wiring, network cables, or other types of wires, cables and/or cords, small pipes, or the like, used for utility services.

Referring to FIGS. 1 to 5B', in the embodiment shown, the structural panel assembly 10 further includes a vertical locking mechanism (or vertical locking assembly) 30. The vertical locking mechanism 30 includes a male member 32 and a female member 34 at opposed upper and lower ends of each structural panel 20. Each one of the male member 32 and the female member 34 of the vertical locking mechanism 30 extends along a longitudinal axis X of the panel 20 and substantially perpendicular to a vertical axis Y of the panel 20.

In the embodiment shown, each one of the male member 32 and the female member 34 of the vertical locking mechanism 30 extends continuously along the panel 20. One skilled in the art will however understand that, in an alternative embodiment (not shown), the male member 32 and/or the female member 34 could include a plurality of sections spaced apart along the longitudinal axis X of the panel 20 (i.e. the male member 32 and/or the female member 34 could be discontinuous along the longitudinal axis X).

The male member 32 has a width 32*a* defined by the distance between the lateral wall surfaces 32*b* thereof. In the embodiment shown, the male member 32 is defined by a protruding section of the structural inner core 22 at the lower end of the structural panel 20 and extends past a lower end of the insulating layers 24. In the embodiment shown, the female member 34 is a recessed section of the structural inner core 22 at the upper end of the structural panel 20 and is recessed from an upper end of the insulating layers 24. In other words, the male member 32 is a projection of the inner core 22 at the lower end of the structural panel 20 and the female member 34 is a recess in the inner core 22 at the upper end of the structural panel 20.

One skilled in the art will easily understand, that, in alternative embodiments (not shown), the male member 32 and female member 34 can be inverted, with the male member 32 defined by a section of the structural inner core 22 protruding at the upper end of the structural panel 20 and the female member 34 being a recessed section of the structural inner core 22, at the lower end of the structural panel 20.

In the embodiment shown, each female member 34 includes a locking slot 36 defined at an inner end thereof. The locking slot 36 is a wider portion of the female member 34 defined at the inner end thereof (i.e. the female member 34 extends laterally further into the inner core 22 in the locking slot 36 than in a remaining section of the female member 34). In other words, in an embodiment, the female member 34 includes a recess having an inverted <<T>> shape extending inwardly in the panel 20. One skilled in the art will understand that, in an alternative embodiment, the locking slot 36 could be positioned at a position different from the inner end of the female member 34. For example, the locking slot 36 could be positioned at an intermediate height of the female member 34.

The vertical locking mechanism 30 further includes at least one locking member 40 (see more particularly FIG. 4) coupled to the male member 32 of the vertical locking mechanism 30. Each one of the at least one locking member 40 is configurable between an unlocked configuration (see FIG. 5A') and a locked configuration (see FIG. 5B'), as will be described in more details below, to vertically lock/unlock vertically adjacent and engaged panels 20 to one another. In the embodiment shown, the vertical locking mechanism 30 includes multiple locking members 40 for each one of the panels 20, with the locking members 40 being regularly spaced apart from one another along the longitudinal axis X of the panel 20. One skilled in the art will however understand that, in an embodiment, the vertical locking mechanism 30 could include a single locking member 40. In the embodiment shown, the locking member 40 has a portion extending at an end of the male member 32 of the vertical locking mechanism 30, but one skilled in the art will understand that, in an alternative embodiment, the locking member 40 could be positioned inwardly of the male member 32 of the vertical locking mechanism 30 (i.e. could be engageable to the male member 32 of the vertical locking mechanism 30 such as to be positioned inwardly from the bottom or top end of the male member 32).

Figure 4:
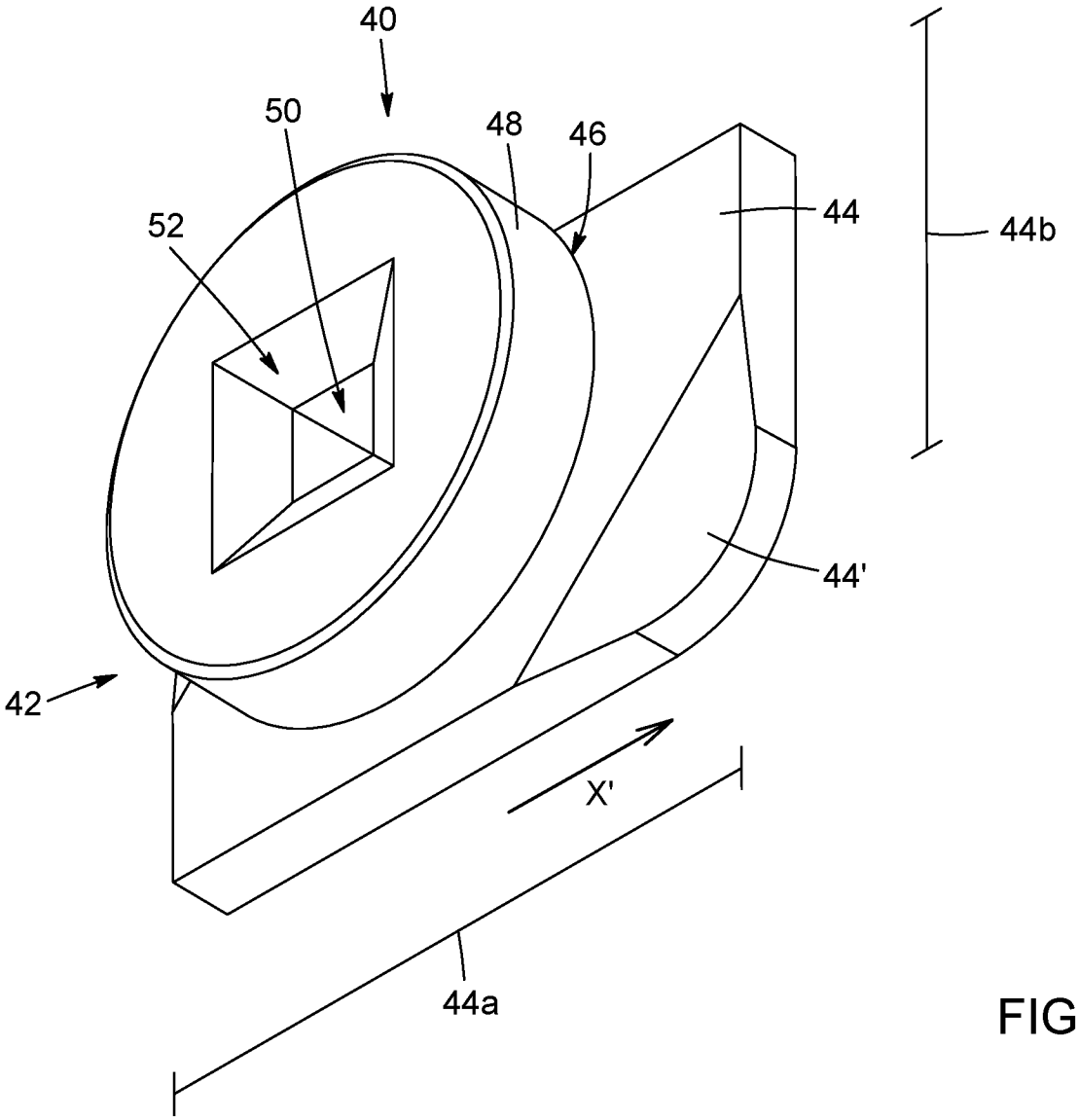
FIG. 4 is a perspective view of a locking member of the structural panel of FIG. 1, in accordance with an embodiment.

Referring more particularly to FIG. 4, in the embodiment shown, each locking member 40 includes a stem 42 and a locking tab 44. The locking tab 44 has a length 44*a* extending along a longitudinally extending locking member axis X' and a width 44*b* extending substantially perpendicular to the longitudinally extending locking member axis X'. The length 44*a* of the locking tab 44 is greater than the width 44*b* of the locking tab 44. In an embodiment, the width 44*b* of the locking tab 44 is narrower than the width 32*a* of the male member 32 of the vertical locking mechanism 30, while the length 44*a* of the locking tab 44 is greater than the width 32*a* of the male member 32 of the vertical locking mechanism 30. In an embodiment, the locking tab 44 also includes at least one beveled corner section 44'.

In other words, each locking member 40 is configured to allow the locking tab 44 of the locking member not to substantially protrude from the lateral wall surfaces 32*b* of the male member 32, when it is positioned to extend longitudinally in the direction of the longitudinal axis X of the panel 20, and to protrude from at least one of the lateral wall surfaces 32*b* of the male member 32 when it is positioned to extend longitudinally substantially perpendicularly to (or at an angle from) the direction of the longitudinal axis X of the panel 20.

In the embodiment shown, each locking member 40 also has an annular recess 46 defined in the stem 42, at a base thereof and adjacent to the locking tab 44. The annular recess 46 defines an abutment head 48 in the stem 42. The abutment head 48 is spaced apart from the locking tab 44. In an embodiment, a tool engagement channel 50 is also defined in the stem 42. The tool engagement channel 50 has an inlet 52 defined at an upper end of the abutment head 48. The inlet 52 of the tool engagement channel 50 is sized and shaped to allow a locking rotative tool (not shown) to be inserted into the tool engagement channel 50 of the locking member 40, to engage the locking member 40 and configure the locking member between the unlocked configuration and locked configuration, as will be described in more details below. In an embodiment, the inlet 52 of the tool engagement channel 50 is inwardly bevelled to help guiding the rotative tool towards the tool engagement channel 50, for insertion therein.

In the embodiment shown, each locking member 40 is a unitary component, with the stem 42 (including the abutment head 48) being integral to the locking tab 44. For example and without being limitative, in an embodiment, each locking member 40 can be made from molded plastic. One skilled in the art will understand that, in an alternative embodiment, the locking members 40 can also be made from other materials, such as metal or the like, and can be made by any known fabrication mean or method such as, additive manufacturing, machining, or the like. One skilled in the art will understand that, in an alternative embodiment (not shown), the components of the locking member 40 can also be joined, connected or secured to one another through securing means and methods such as brazing, welding, soldering, gluing, fastening or the like.

In an alternative embodiment (not shown), each locking member 40 can further include a tightening section, along the stem 42 thereof, to allow selective shortening of the stem 42 of the locking member 40 (and consequent vertical tightening of vertically adjacent panels). In an embodiment, the tightening section can be of the screwable type, where the stem 42 includes a first threaded stem section and a second complementary threaded stem section, with the first stem section being screwable onto the second stem section. Therefore, when the first stem section is rotated with regards to the second stem section, the first stem section is screwed onto the second stem section, thereby shortening the length of the stem 42 of the locking member 40. In an embodiment, the tool engagement channel 50 can include a locking section sized and shaped to engage the above-mentioned locking rotative tool (not shown) insertable into the locking section to engage the locking member 40 and configure the locking member 40 between the unlocked configuration and locked configuration, and a screwing section sized and shaped to engage a screwing rotative tool (not shown) insertable into the screwing section to engage the first stem section of the locking member 40 and screw the first stem section onto the second stem section to shorten the length of the stem 42 of the locking member 40. In an embodiment, the screwing section can be positioned upwardly of the locking section and have a greater diameter, such that the locking rotative tool can extend therethrough and be rotated without engaging the first section in rotation.

Figure 1A:
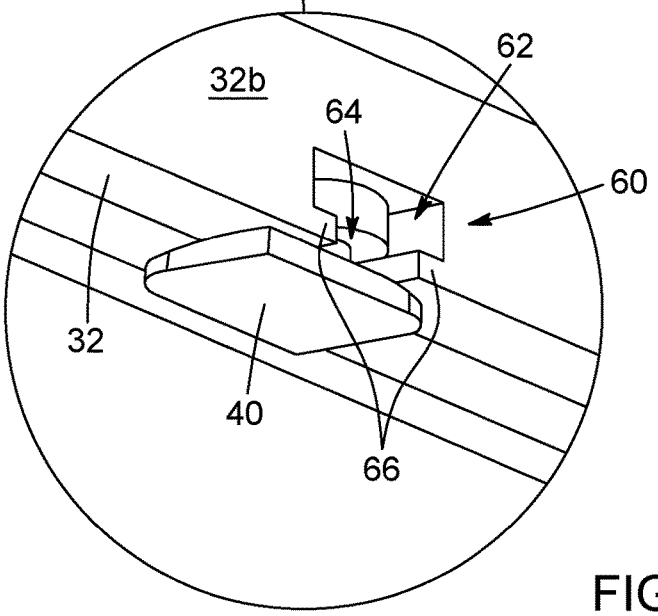
FIG. 1A is a close-up perspective view of section 1*a* of the structural panel of FIG. 1.

Referring more particularly to FIG. 1*a*, in the embodiment shown, the male member 32 of the vertical locking mechanism 30 includes at least one locking member receiving assembly 60 allowing each one of the at least one locking member 40 to be operatively engaged with the male member 32, with the locking tab 44 extending outside of the male member 32, at the lower end of the male member 32. One skilled in the art will understand that, in an alternative embodiment (not shown) where the male member 32 extends from the structural inner core 22 at the upper end of the structural panel 20, the at least one locking member receiving assemblies 60 can each be configured to allow a corresponding locking member 40 to be operatively connected to the male member 32, with the locking tab 44 extending outside of the male member 32, at the upper end of the male member 32.

In the embodiment shown, the locking member receiving recesses 60 includes an abutment head receiving cavity 62 and a stem receiving channel 64 defined in the male member 32 and opened on a lateral surface thereof. The abutment head receiving cavity 62 is positioned inwardly from the stem receiving channel 64 (i.e. it is positioned further inside the inner core 22 than the stem receiving channel 64) and has a width greater than the stem receiving channel 64 for receiving and vertically retain the abutment head 48 of a corresponding locking member 40. The abutment head receiving cavity 62 is partially closed at an outer end thereof (i.e. a lower end in the embodiment shown) by annular recess engaging walls 66 extending substantially perpendicular to the vertical axis Y, on opposed sides of the stem receiving channel 64. Hence, the combination of the abutment head receiving cavity 62 and stem receiving channel 64 allows a corresponding one of the locking members 40, to be inserted into the male member 32, from the lateral side into which the abutment head receiving cavity 62 and stem receiving channel 64 are opened, with the abutment head of the locking member 40 being received in the abutment head receiving cavity 62 and the annular recess engaging walls 66 being inserted in the annular recess 46 of the locking member 40. When the locking member 40 is received in the corresponding locking member receiving assembly 60, as described above, the locking member 40 remains rotatable while being vertically secured to the male member 32 of the vertical locking mechanism 30 (i.e. the locking member 40 is interlocked with the male member 32, and consequently with the panel 20, along the vertical axis Y and cannot be substantially moved vertically), with the locking tab 44 being juxtaposed to the lower surface of the male member 32.

In an embodiment, each locking member receiving assembly 60 further includes at least one locking aperture 68 extending through the structural inner core 22. Each locking aperture 68 is substantially in register with the tool engagement channel 50 of the corresponding locking member 40 (when the abutment head 48 of a corresponding locking member 40 is inserted in the abutment head receiving cavity 62 of the locking member receiving assembly 60) and extends between one of the abutment head receiving cavities 62 and an inner surface (corresponding to a lower surface in the embodiment shown) of the recess defining the female member 34 to allow an elongated shaft (or rod or stem) of the above mentioned rotative tool (not shown) to be inserted therein and to engage into the tool engagement channel 50 of the corresponding locking member 40. Therefore, the locking member 40 can be rotated between the unlocked configuration and the locked configuration, using the rotative tool (not shown) (i.e. by rotating the rotative tool having a section thereof engaged in the tool engagement channel 50 of the locking member 40).

One skilled in the art will understand that, in alternative embodiments (not shown), the locking member 40 and/or the locking member receiving assembly 60 can have a configuration different from the embodiment shown (i.e. can be sized and shaped differently than in the embodiment shown), while still allowing the above-described operative engagement between the locking member 40 and the male member 32 of the vertical locking mechanism 30 of the panel 20, for vertical interlock therebetween, and the required above-described configuration switch between the locked configuration and the unlocked configuration. For example and without being limitative, in an embodiment (not shown), the locking member 40 can be free of stem 42, with the tool engagement channel 50 being defined directly in the locking tab 44 and the locking member receiving recesses 60 being configured to receive and maintain a locking member 40 free of stem 42 and corresponding abutment head 48 (i.e. being configured to receive and maintain the locking tab 44 directly therein and allow rotation thereof).

Figure 5A:
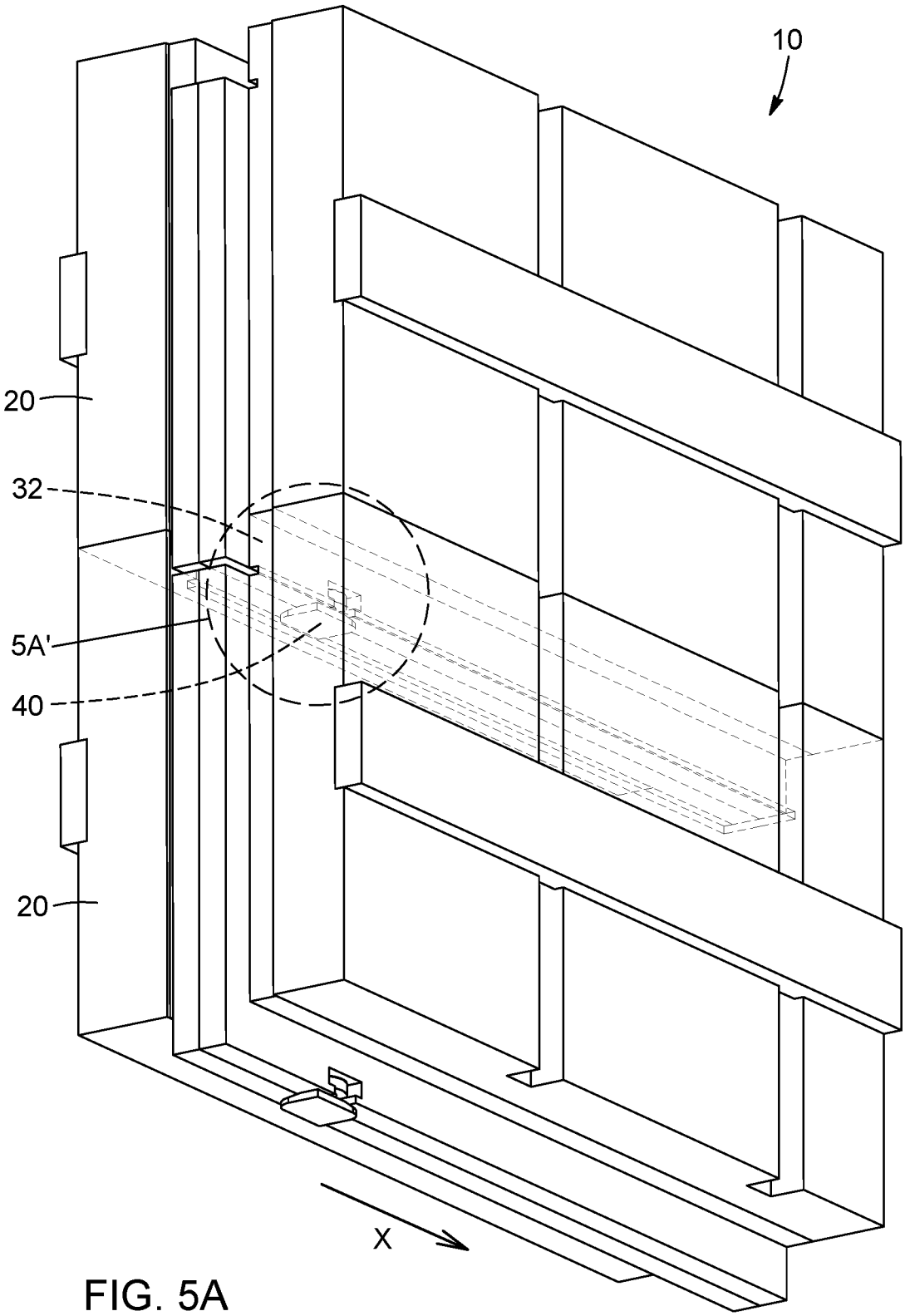
FIG. 5A is a perspective view of two vertically adjacent panels engaged to one another, with the locking member configured in an unlocked configuration.
Figure 5A:
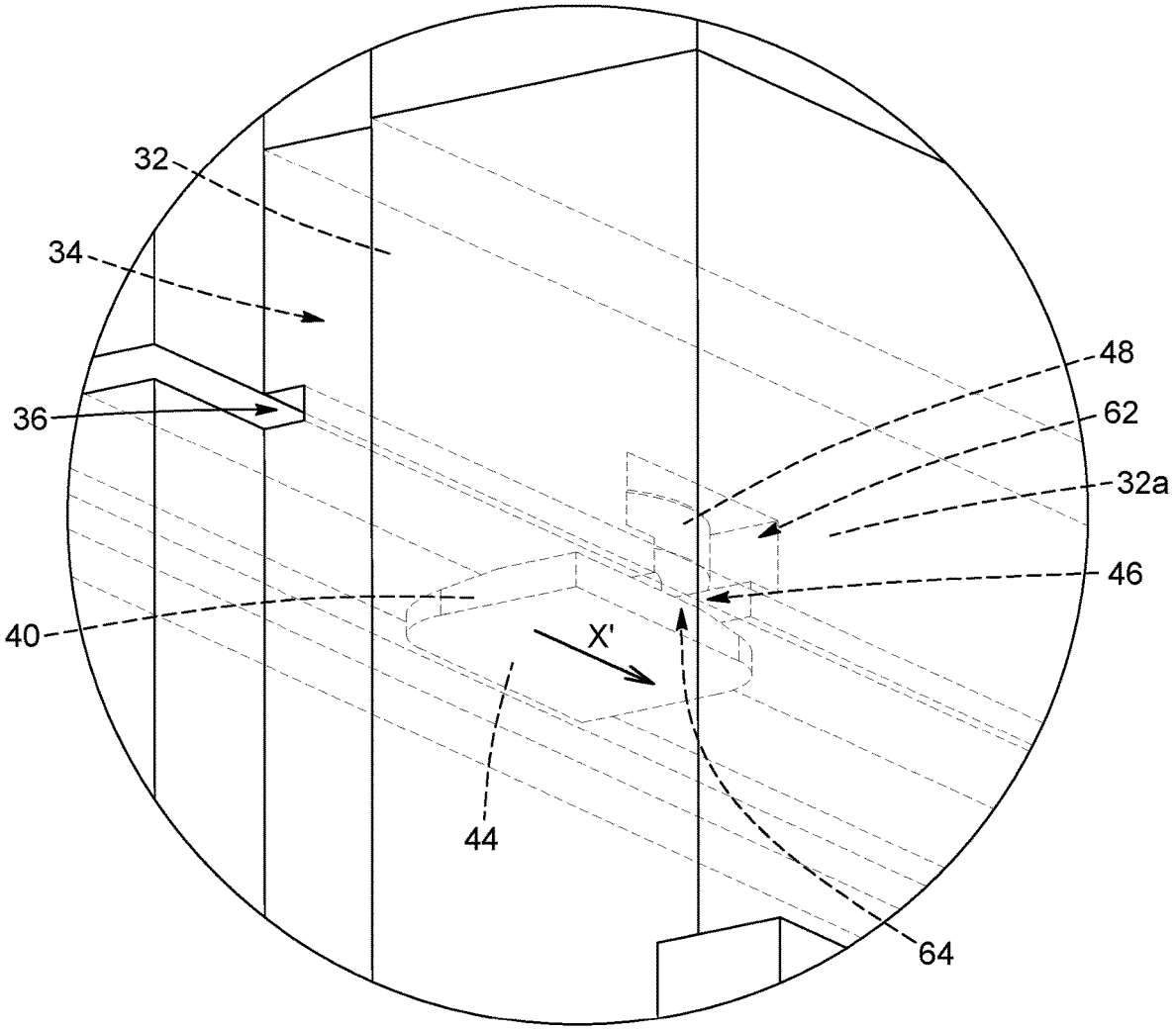
Figure 5B:
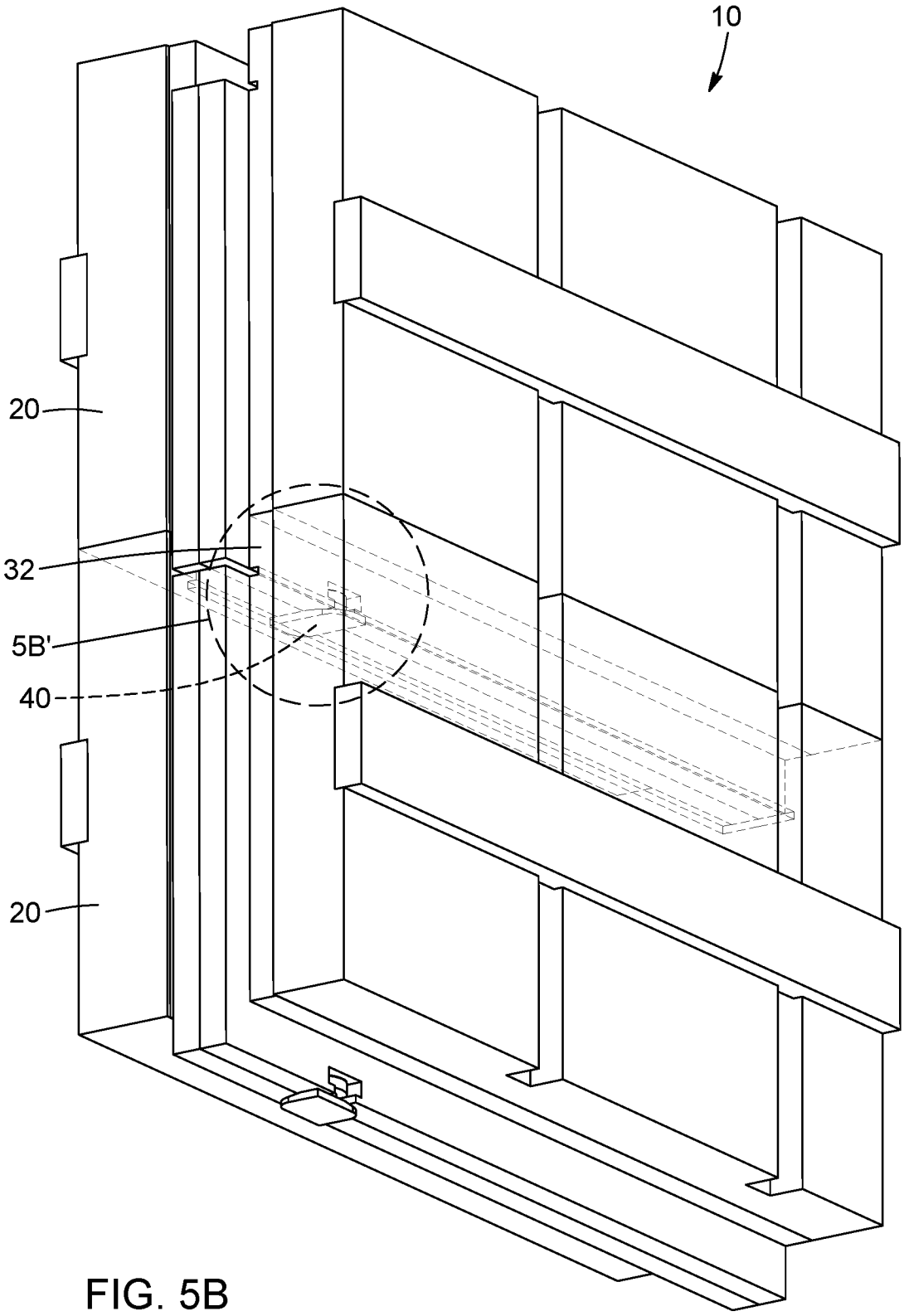
FIG. 5B is a perspective view of the two vertically adjacent panels vertically engaged to one another of FIG. 5A, with the locking member configured in a locked configuration.
Figure 5B:
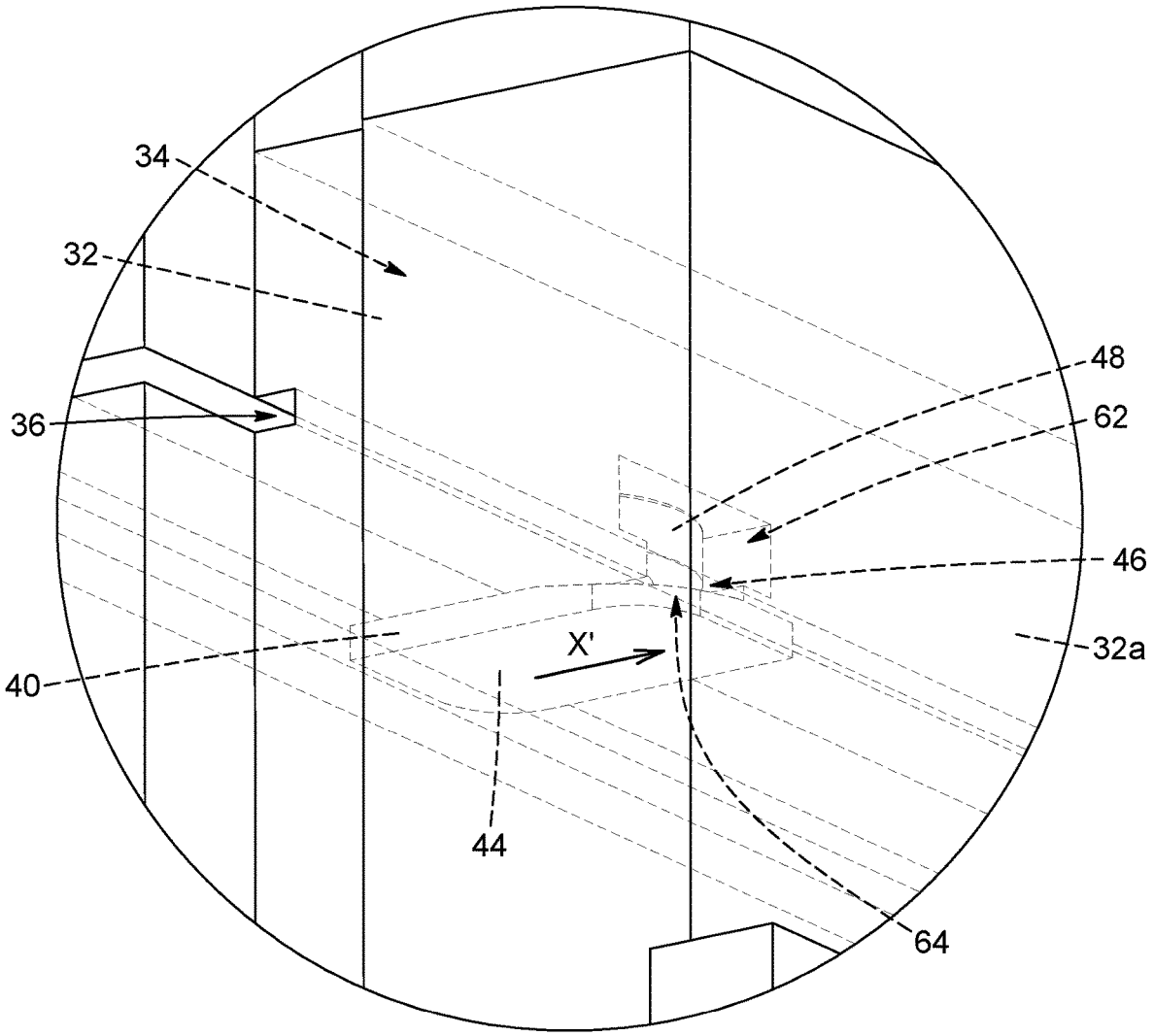

Referring to FIGS. 5A to 5B', as mentioned above, the locking member 40 can be rotated between the unlocked configuration and the locked configuration. In the unlocked configuration (see FIGS. 5A and 5A'), the locking tab 44 of the locking member 40 is substantially longitudinally aligned with the male member 32 of the vertical locking mechanism 30 (i.e. the longitudinal axis X' of the locking tab 44 extends substantially parallel to the longitudinal axis X of the panel 20), and does not substantially protrude outwardly thereof. In the locked configuration (see FIGS. 5B and 5B'), the locking tab 44 of the locking member 40 is substantially longitudinally perpendicular to the male member 32 of the vertical locking mechanism 30 (i.e. the longitudinal axis X' of the locking tab 44 extends substantially perpendicular to the longitudinal axis X of the panel 20), and portions thereof protrude outwardly of the male member 32 (i.e. protrude past the lateral wall surfaces 32*b* of the male member 32). In an alternative embodiment (not shown), in the locked configuration, the locking tab 44 of the locking member 40 could protrude past only one of the lateral wall surfaces 32*b* of the male member 32.

In view of the above and as can be better seen in FIGS. 5A and 5A', it will be understood that, when the locking member 40 is configured in the unlocked configuration, the locking tab 44 does not substantially extend beyond the lateral wall surfaces 32*b* of the male member 32 (given that, as mentioned above, the width 44*b* of the locking tab 44 is smaller than the width 32*a* of the male member 32 of the vertical locking mechanism 30) and therefore do not hinder insertion of the male member 32 into the female member 34 of a vertically adjacent one of the panels 20. As can be better seen in FIGS. 5B and 5B', to configure the locking member 40 in the locked configuration, the locking member 40 is rotated such that the longitudinal axis X' of the locking tab 44 extends substantially perpendicular to the longitudinal axis X of the panel 20 and the locking tab extend laterally outwardly of the lateral wall surfaces 32*b* of the male member 32 at the outer end of the male member 32. In the locked configuration, a portion of the locking tab 44 extends into the locking slot 36 of the female member 34 of the vertically adjacent one of the panels 20, thereby vertically locking (or removably securing) the two vertically adjacent panels 20 together.

Figure 6:
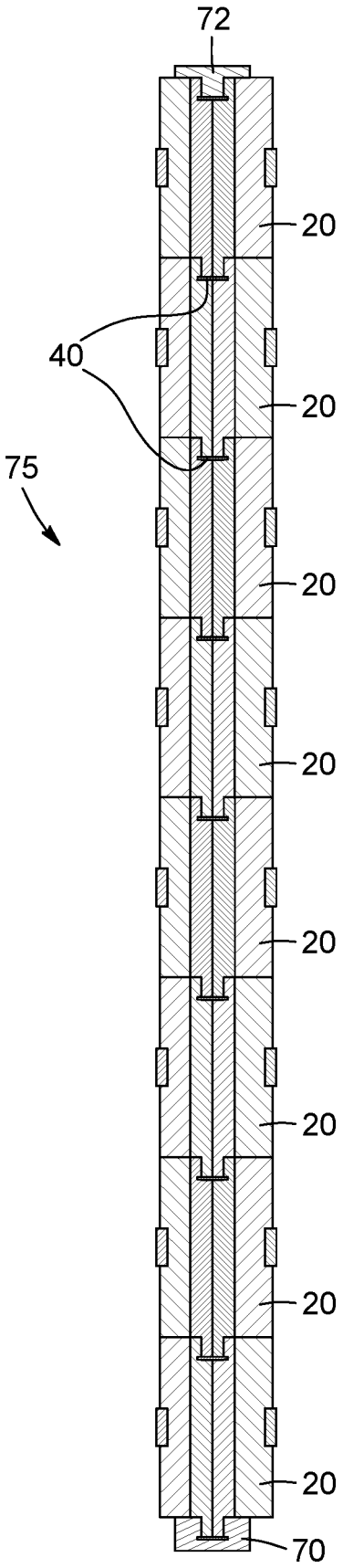
FIG. 6 is a cross-section view of a building wall including a plurality of the structural panels of FIG. 1 vertically engaged and vertically locked to one another.

In view of the above, as can be seen more clearly in FIGS. 5A to 6, multiple vertically adjacent panels 20 can therefore be engaged and secured to one another to build a building wall 75. More precisely, in an embodiment each one of the vertically adjacent panels 20 are initially engaged through insertion of the male member 32 of one of the panels into the female member 34 of the vertically adjacent panel, with the locking member 40 being configured in the unlocked configuration. Subsequently, each one of the at least one locking member 40 is rotated towards the locked configuration, thereby vertically securing the corresponding vertically adjacent panels 20 to one another. The process is repeated for each successive panel being engaged and secured to a vertically adjacent panel 20 to build the wall 75.

Figure 7A:
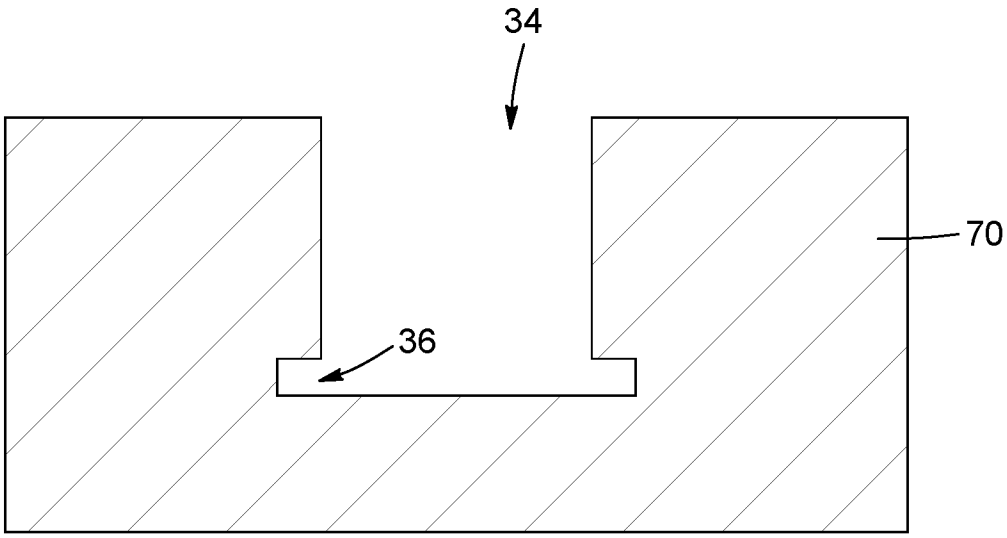
FIG. 7A is a cross-section view of a bottom end cap, in accordance with an embodiment.
Figure 7B:
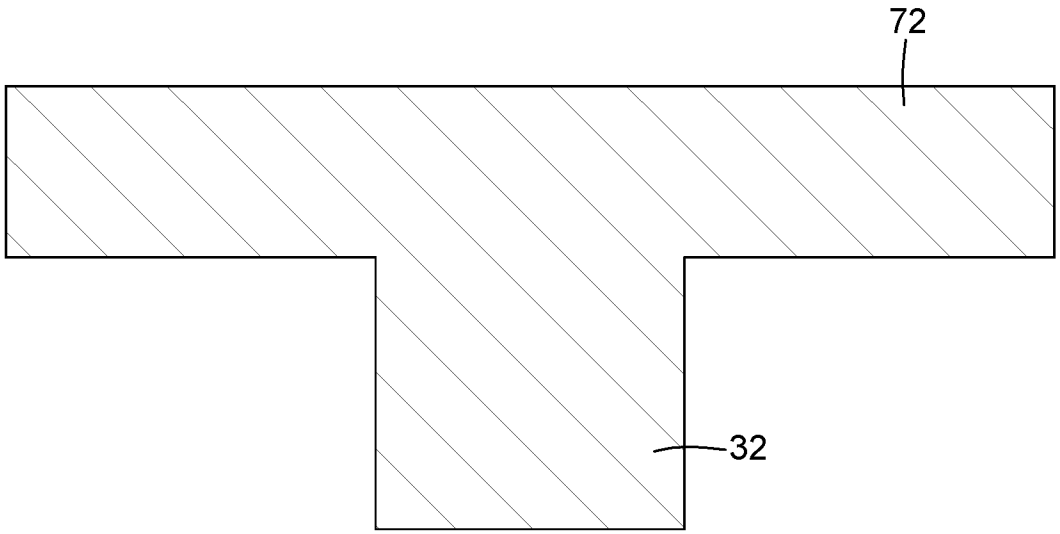
FIG. 7B is a cross-section view of an upper end cap, in accordance with an embodiment.

Referring to FIGS. 7A and 7B, in the embodiment shown, a structural panel assembly 10 can further include a bottom end cap 70 and an upper end cap 72 configured to engage and secure with a corresponding panel 20, respectively at a bottom end of the wall 75 and a top end of the wall 75. In an embodiment, the bottom end cap 70 and/or upper end cap 72 can also be used to cap wall section(s), at intermediate heights, for example in order to define a window aperture, a door aperture or the like.

In the embodiment shown, the bottom end cap 70 includes a female member 34 with a locking slot 36 defined therein and the upper end cap 72 has a male member 32 engageable to the female member 34 of an upper panel 20 of the wall 75. The lowermost panel 20 of the wall 75 (or wall section in the case of an aperture provided in a wall 75) and the bottom end cap 70 engages and locks similarly to vertically adjacent panels 20, as described above. In an embodiment, the uppermost panel 20 of the wall 75 (or wall section in the case of an aperture provided in a wall) and the upper end cap 72 can engage simply by inserting the male member 32 of the upper end cap 72 into the female member 34 of the upper panel 20 of the wall 75 (and possibly be secured to one another using alternative methods such as bonding, gluing or the like), without vertically locking the components to one another as described above. In an alternative embodiment (not shown), a locking assembly similar to the above-described vertical locking mechanism 30 could also be used for locking the upper panel 20 of the wall 75 and the upper end cap 72 together.

In view of the above, in an embodiment, to build a building wall 75, a first structural panel can be engaged to the bottom end cap 70 by inserting the male member 32 of the first panel into the female member 34 the bottom end cap 70, with the locking member 40 operatively connected to the male member 32 of the first panel configured in the unlocked configuration and vertically locking the first panel and the bottom end cap 70 together by configuring the locking member 40 into the locked configuration.

In the embodiment, shown, male/female engagement members, without locking assembly are provided on the opposed longitudinal ends of the panels 20 (i.e. the ends spaced apart along the longitudinal axis X). One skilled in the art will understand that, in an embodiment (not shown), an engagement/locking assembly, similar to the above-described vertical locking mechanism 30 can also be provided on the opposed longitudinal ends of the panels 20 for engaging and/or locking laterally adjacent panels in a wall 75 having multiple adjacent panels 20. In other words, in such an embodiment, both vertically and laterally adjacent panels can be locked to one another in a wall 75.

Now referring to FIGS. 8 to 17, in an embodiment, a corner securement assembly 80 is also provided to secure two horizontally adjacent panels 20*a*, 20*b* (or wall sections 75 build using a plurality of vertically adjacent panels 20) positioned at an angle relative to one another and defining a corner wall structure.

Referring to FIGS. 8 to 11, in an embodiment the corner securement assembly 80 can be designed to secure the two horizontally adjacent panels 20*a*, 20*b* (or wall sections 75) in a right angle configuration. For ease of description, in the description below only reference to two horizontally adjacent panels 20*a*, 20*b* will be made, even though the corner securement assembly 80 can be used to secure two wall sections 75 built using a plurality of vertically adjacent panels 20, in a corner structure.

The corner securement assembly 80 includes a vertically extending securement anchor 82 operatively securable to the inner core 22 of the first panel 20*a* and second panel 20*a*. In the embodiment of FIGS. 8 to 11, the securement anchor 82 is an "L" shaped brace having first and second walls (or plates) 82*a*, 82*b* joined at substantially a 90° vertical angle. The securement anchor 82 is superposable to a longitudinal end surface 21 of the inner core 22 of the first panel 20*a* and the second panel 20*b*.

The securement anchor 82 includes bracket engagement apertures 84 defined therein. Each one of the bracket engagement aperture 84 is sized and shaped to engage and horizontally lock with a securing bracket 90 engageable to the securement anchor 82. In other words, each one of the bracket engagement aperture 84 is configured to allow engagement between the securement anchor 82 and a corresponding securing bracket 90, with the securing bracket 90 being horizontally interlocked with the securement anchor 82 (preventing movement of the securing bracket 90 along the longitudinal axis X of the corresponding panel 20), when the securing bracket 90 is engaged to the securement anchor 82. In the embodiment shown, the securement anchor 82 includes a plurality of bracket engagement apertures 84, each one of the bracket engagement apertures 84 being positioned to secure one panel 20 to the securement anchor 82, using one of the securing brackets 90, as will be described in more details below.

Each securing bracket 90 includes an engagement section 92 at least partially insertable into a corresponding bracket engagement aperture 84 of the securement anchor 82 and lockable against the securement anchor 82 to horizontally interlock the securing bracket 90 with the securement anchor 82. For example and without being limitative, in the embodiment shown, the engagement section 92 is sized and shaped to be at least partially insertable through the engagement aperture 84 when the securing bracket 90 is oriented according to an insertion orientation (not shown) and at least partially prevented from moving horizontally through the engagement aperture 84 when the securing bracket 90 is oriented according to an interlocked orientation (see FIG. 9). For example, in an embodiment, the securing bracket 90 can be rotated of approximately 90° in one of a clockwise or counter-clockwise direction to be moved between the insertion orientation and the interlocked orientation. Therefore, the securing bracket 90 can be engaged with the securement anchor 82 by initially positioning the securing bracket 90 in the insertion orientation and inserting at least a portion of the engagement section 92 thereof in the corresponding engagement aperture 84 of the securement anchor 82 and subsequently positioning the securing bracket 90 in the interlocked orientation to interlock the securement anchor 82 and securing bracket 90 with one another (i.e. to prevent the bracket 90 to be pulled away from the securement anchor 82 along the longitudinal axis X of the corresponding panel 20). One skilled in the art will understand that, in alternative embodiments (not shown), other assemblies for selectively securing the bracket 90 to the securement anchor 82 can also be provided.

Each securing bracket 90 also includes a fastening section 94 fastenable to the corresponding one of the first and second horizontally adjacent panels 20*a*, 20*b*. In the embodiment shown, the fastening section 94 is angled relative to the engagement section 92 of a vertical angle of about 90°, but one skilled in the art will understand that, in alternative embodiments, the fastening section 94 can be angled differently relative to the engagement section 92. In the embodiment shown, the fastening section 94 of the securing bracket 90 can be fastened to the inner core 22 of the first and second horizontally adjacent panels 20*a*, 20*b*, using known fasteners such as nails, screws or the like. For example and without being limitative, the fastening section 94 of the securing bracket 90 can be fastened to a lower surface of the female member 34 of the corresponding one of the first and second horizontally adjacent panels 20*a*, 20*b*, to secure the first panel 20*a* and second panel 20*b* to the securement anchor 82 and therefore securing the first panel 20*a* and second panel 20*b*, in a corner configuration. In an embodiment, the fastening section 94 includes fastening apertures 95 extending through the securing bracket 90, for insertion of fasteners therethrough.

Figure 11:
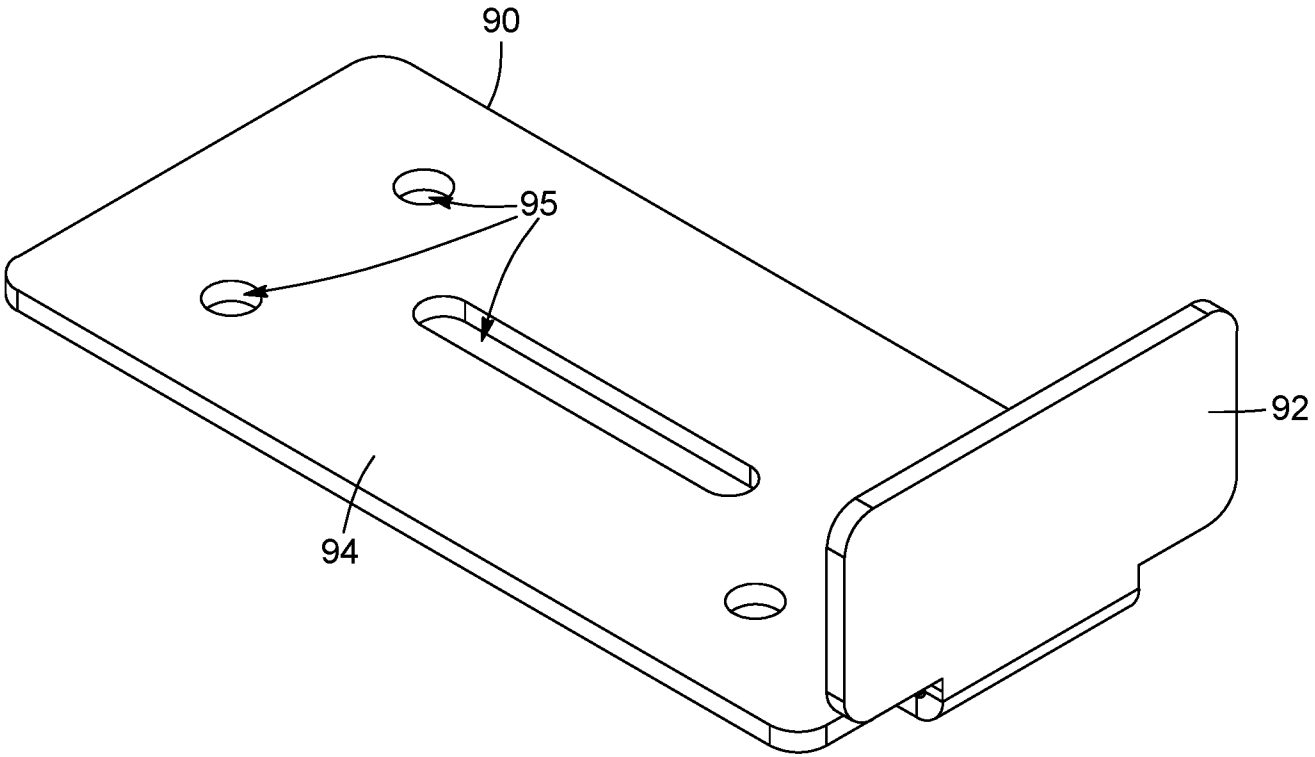
FIG. 11 is a perspective view of a corner securing bracket of the corner securement assembly of FIGS. 8 and 9.
Figure 12:
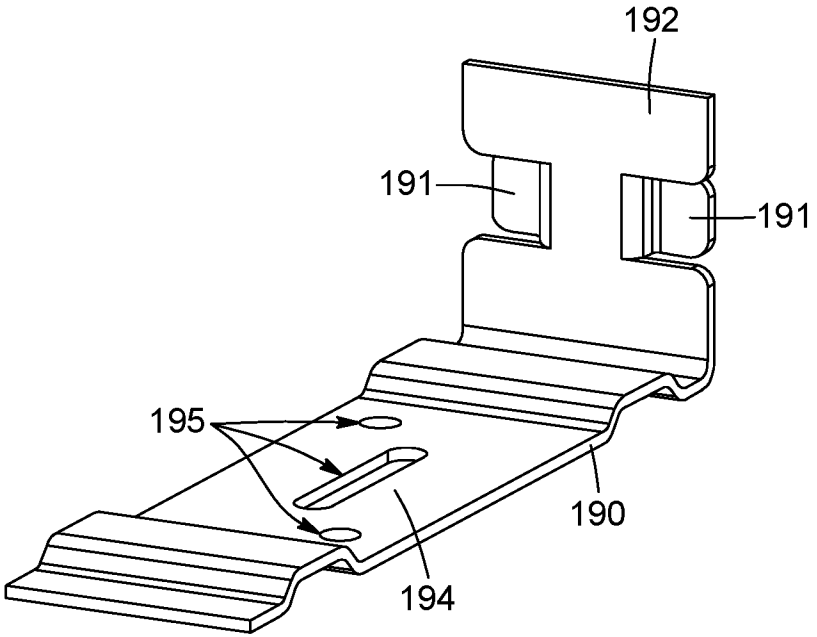
FIG. 12 is a perspective view of a corner securing bracket of the corner securement assembly, in accordance with an alternative embodiment.

One skilled in the art will understand that, in alternative embodiments, the securing bracket 90 could have a design different from the design shown in FIG. 11, while still allowing the horizontal locking with the securement anchor 82 and securement to the corresponding one of the horizontally adjacent panels 20*a*, 20*b*. For example and without being limitative, referring to FIG. 12, there is shown an alternative embodiment of the securing bracket 90 wherein similar features are numbered using the same reference numerals in the 100 series. The securing bracket 190 has an engagement section 192 and a fastening section 194 angled relative to the engagement section 192 of an angle of about 90°. The engagement section 192 includes lateral flanges 191 selectively insertable in the corresponding bracket engagement aperture 84 of the securement anchor 82. The lateral flanges 191 are insertable through the corresponding one of the at least one bracket engagement aperture when the securing bracket 190 is oriented in the insertion orientation and prevented from moving through the engagement aperture when the securing bracket 190 is oriented in the interlocked orientation. The fastening section 194 includes fastening apertures 195 extending through the securing bracket 190, for insertion of fasteners therethrough, similarly to the above described securing bracket 90 shown in FIG. 11.

In view of the above, the first and second horizontally adjacent panels 20*a*, 20*b* can be secured in a corner configuration by securing each one of the first and second horizontally adjacent panels 20*a*, 20*b* to the securement anchor 82. In the embodiment shown, each one of the first and second horizontally adjacent panels 20*a*, 20*b* is secured to a corresponding wall (or plate) 82*a*, 82*b*, of the "L" shaped brace operating as securement anchor 82, through the securing bracket 90 having its engagement section 92 interlocked with the securement anchor 82 and its fastening section 94 fastened to the inner core 22 of the corresponding one of the first and second horizontally adjacent panels 20*a*, 20*b*.

Figure 8:
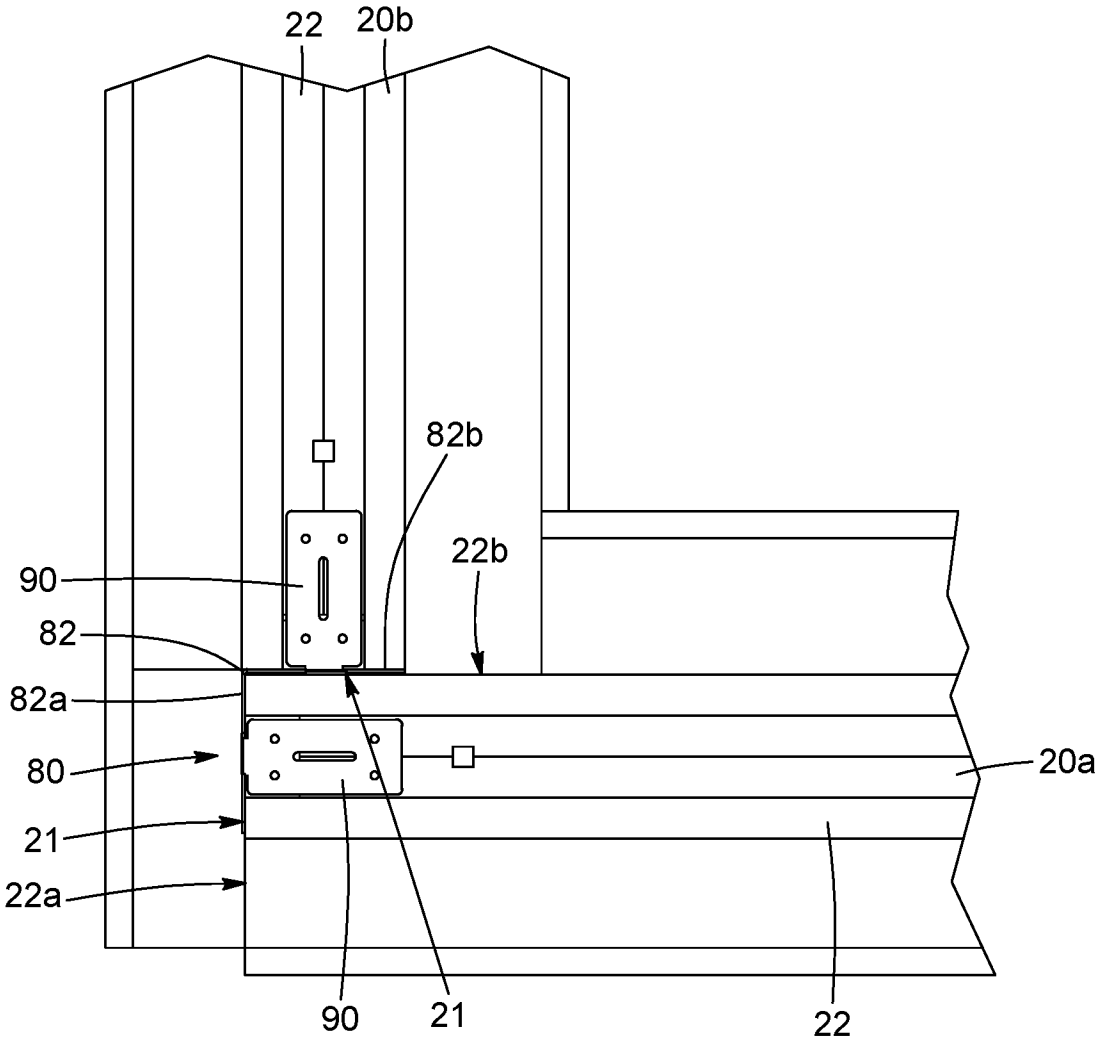
FIG. 8 is a top perspective view of a section of two horizontally adjacent structural panels arranged in a right-angle corner configuration and secured using a corner securement assembly including an "L" shaped brace as securement anchor, in accordance with an embodiment.
Figure 9:
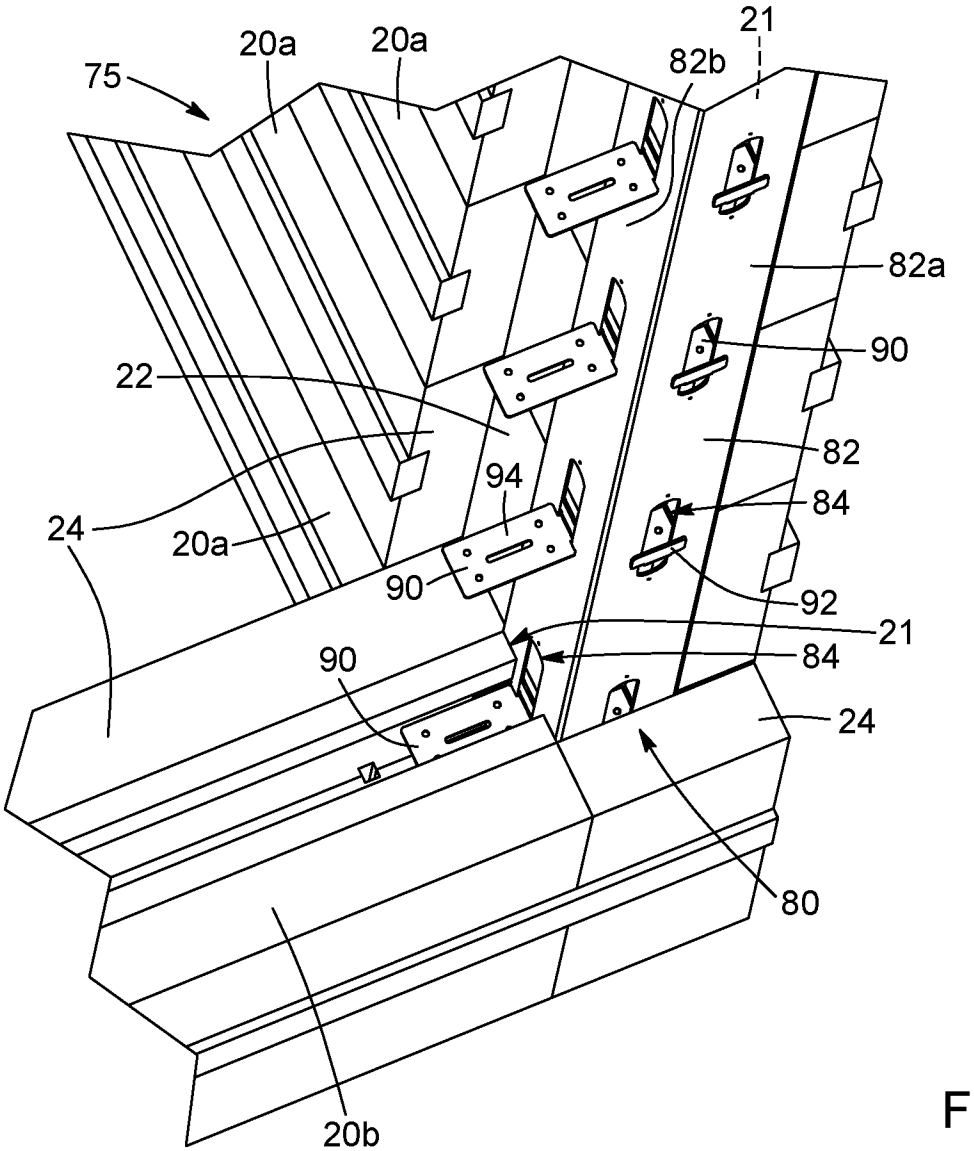
FIG. 9 is a close-up perspective view of a section of corner section of a structural panel assembly and a building wall built using a plurality of panels, arranged in the right-angle corner configuration and secured using the corner securement assembly including the "L" shaped brace as securement anchor.
Figure 10:
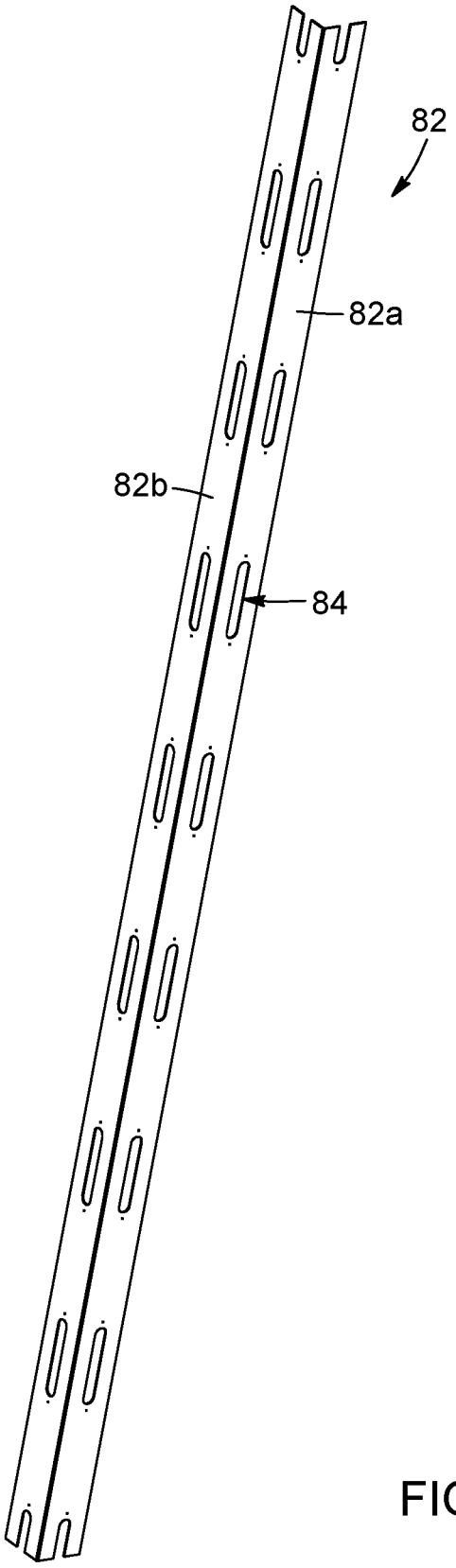
FIG. 10 is a perspective view of the "L" shaped brace used as securement anchor of the corner securement assembly of FIGS. 8 and 9.

In the embodiment shown in FIGS. 8 and 9, in order to allow the first and second horizontally adjacent panels 20*a*, 20*b* to be arranged in a corner structure, without compromising the insulating properties thereof, the first panel 20*a* has a section of one of the rigid insulating layer 24 removed (i.e. the corresponding rigid insulating layer 24 does not cover the entire outer surface of the inner core 22 on the corresponding side thereof) and the second panel 20*b* has a section of rigid insulating layer 24 extending longitudinally beyond the inner core 22. When the first and second horizontally adjacent panels 20*a*, 20*b* are arranged in a corner structure, the section of the rigid insulating layer 24 of the second panel 20*b* extending longitudinally beyond the inner core 22 covers the uninsulated portion of the inner core 22 of the first panel 20*a* (i.e. covers the longitudinal end surface 21 of the inner core 22 of the first panel 20*a*), with the longitudinal end surface 21 of the inner core 22 of the first panel 20*a* superposed to the first wall (or plate) 82*a* of the "L" shaped brace of the securement anchor 82 and the longitudinal end surface 21 of the inner core 22 of the second panel 20*b* superposed to the second wall (or plate) 82*b* of the "L" shaped brace of the securement anchor 82.

Figure 13:
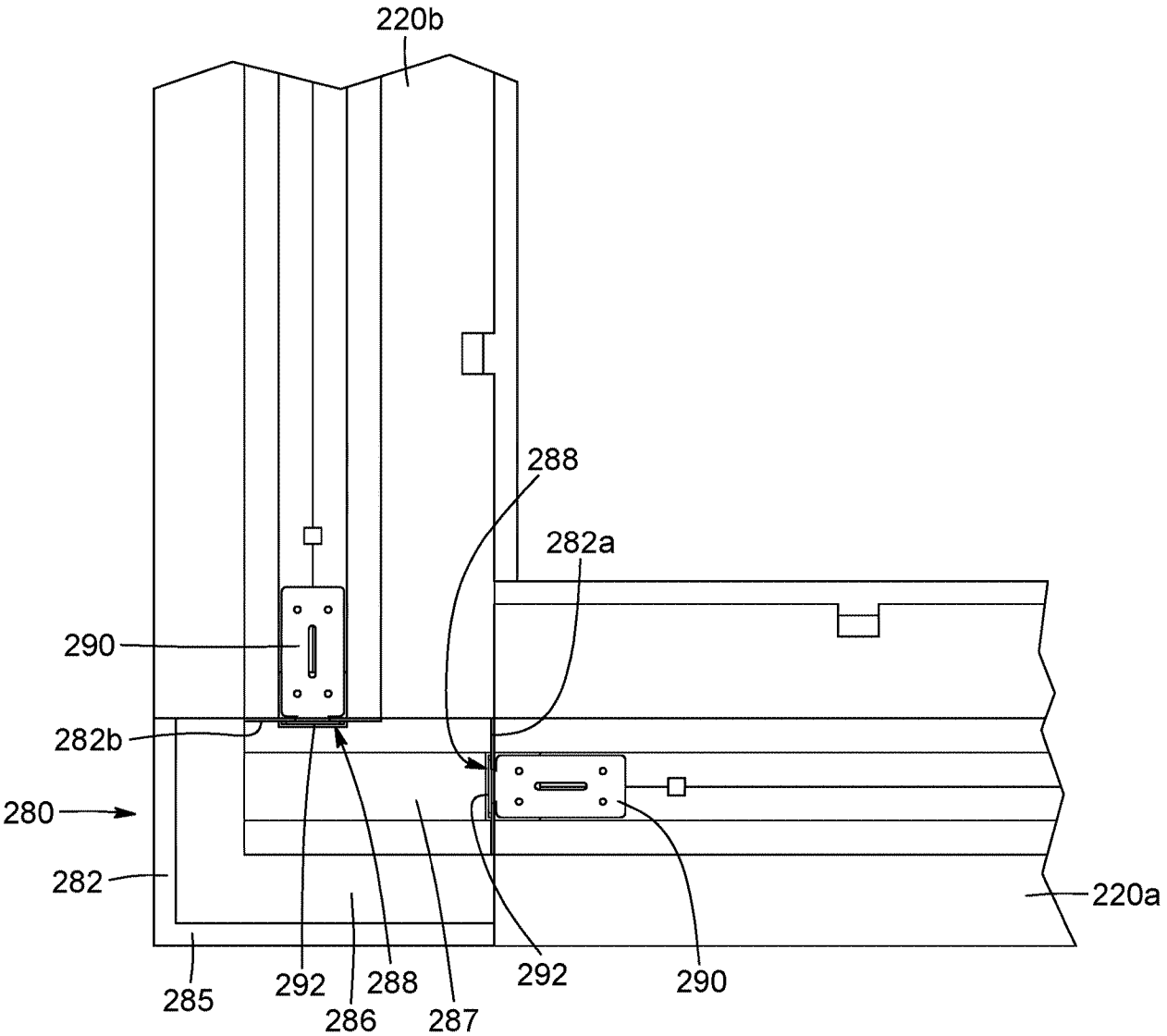
FIG. 13 is a top perspective view of two horizontally adjacent structural panels arranged in a right-angle corner configuration and secured using a corner securement assembly including an insulated corner securement anchor, in accordance with an embodiment.
Figure 14:
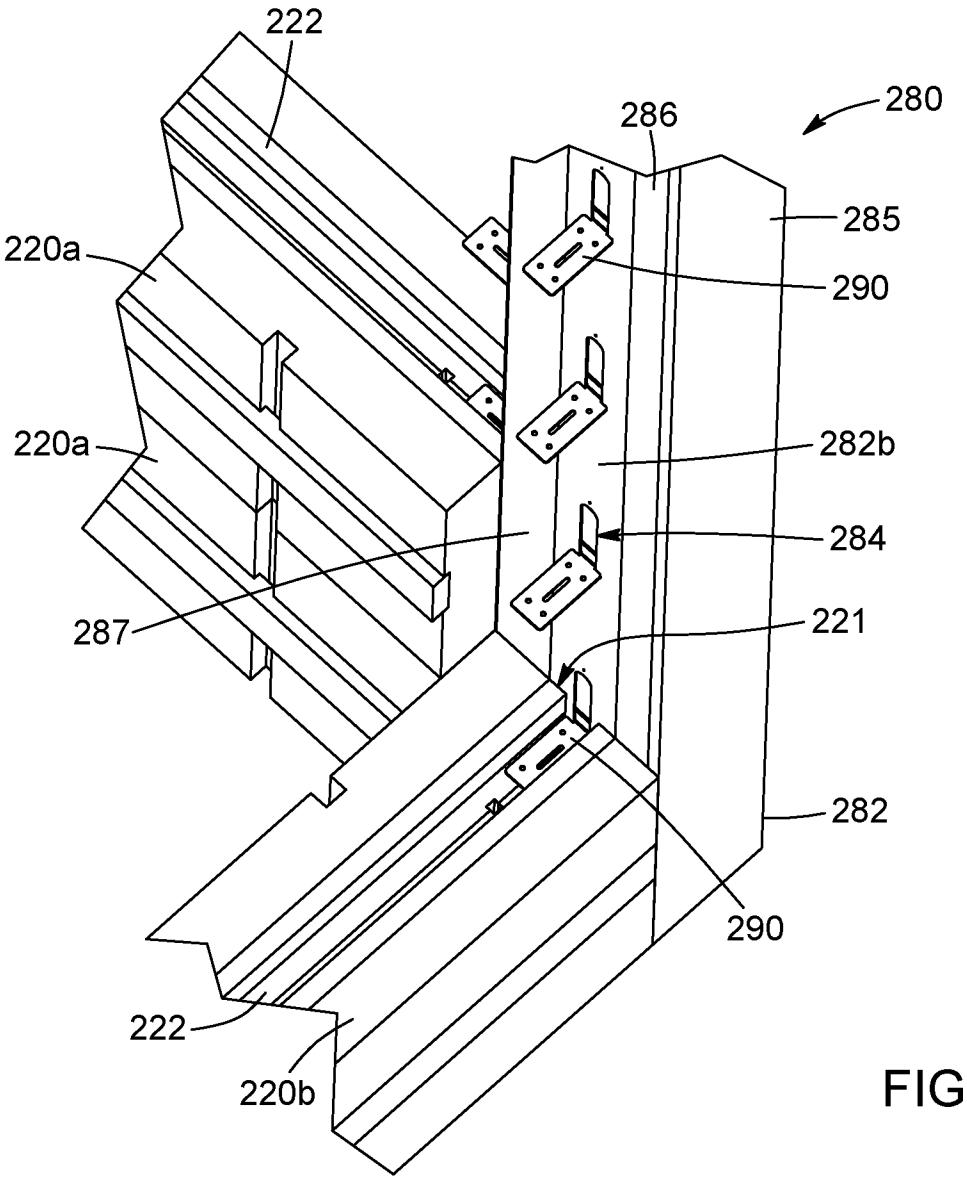
FIG. 14 is a close-up perspective view of a corner section of a structural panel assembly and a building wall built using a plurality of panels, arranged in the right-angle corner configuration and secured using the corner securement assembly including the insulated securement anchor.
Figure 15:
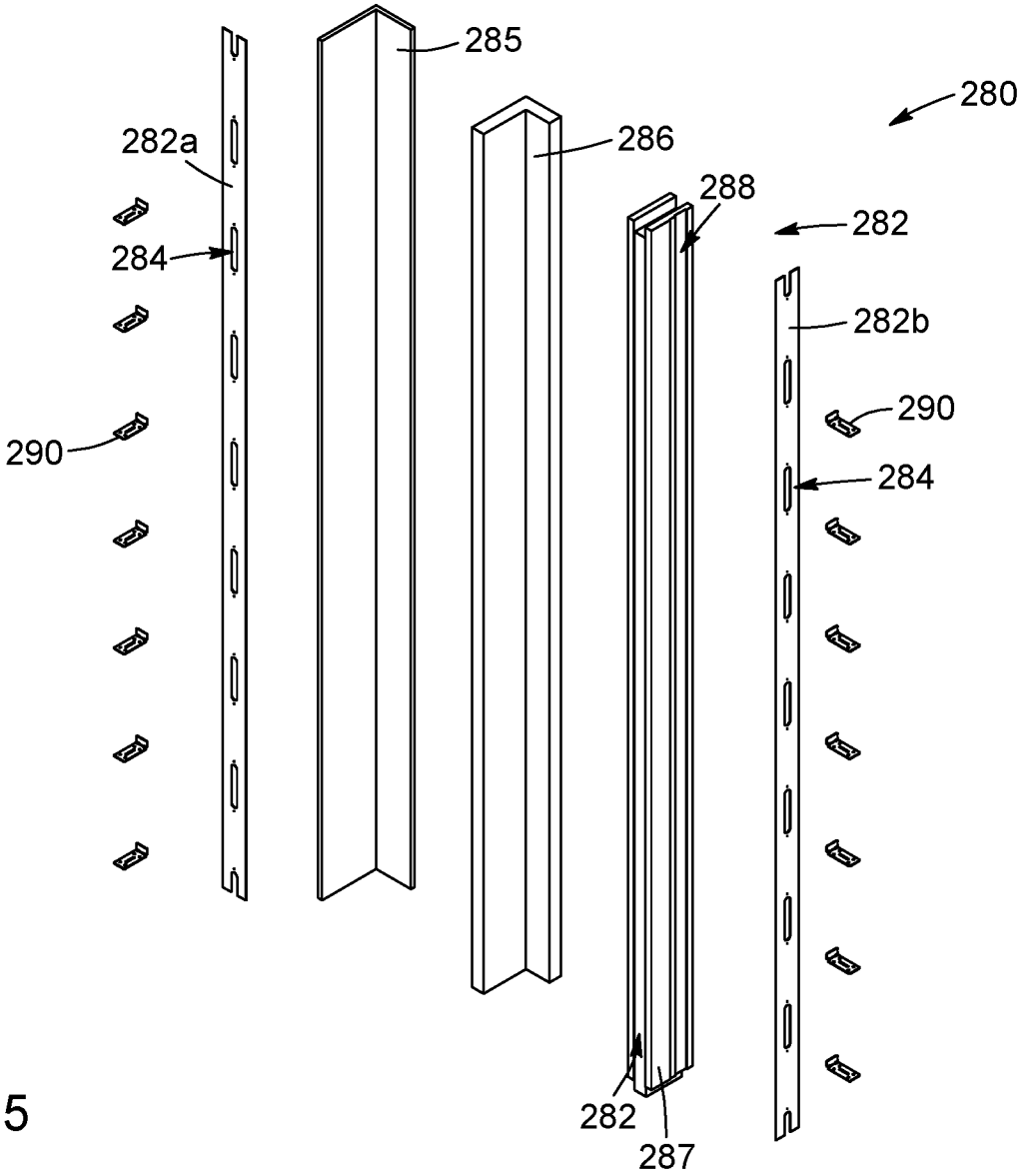
FIG. 15 is an exploded view of the insulated securement anchor of the corner securement assembly of FIGS. 14 and 15.

Referring to FIGS. 13 to 15, there is shown an alternative embodiment of the corner securement assembly 80, wherein similar features are numbered using the same reference numerals in the 200 series.

In the embodiment of FIGS. 13 to 15, the corner securement assembly 280 is once again designed to secure the two horizontally adjacent panels 220*a*, 220*b* (or wall sections 275) in a right-angle configuration. Once again, for ease of description, in the description below only reference to two horizontally adjacent panels 220*a*, 220*b* are made, even though the corner securement assembly 280 can be used to secure two wall sections 275 built using a plurality of vertically adjacent panels 220, in a corner structure.

The corner securement assembly 280 includes a securement anchor 282 operatively securable to the inner core 222 of the first panel 220*a* and second panel 220*a*. In the embodiment of FIGS. 13 to 16, the securement anchor 282 is an insulated securement anchor (see particularly FIG. 15) including an external structural wall section 285, an insulation layer 286, a structural core post 287 and first and second securement plates 282*a*, 282*b* joined to the structural core post 287, and at substantially a 90° angle from one another (i.e. the first and second securement plates 282*a*, 282*b* are oriented to define a vertical angle of about 90° therebetween). In an embodiment, the external structural wall section 285, insulation layer 286, structural core post 287 and first and second securement plates 282*a*, 282*b* are joined to one another, for example by bonding, to form a single assembly.

The external structural wall section 285 is an L shaped portion made of rigid material providing sufficient rigidity, compressive strength and/or tensile strength, similarly to the material of the structural inner core 22 of the panels. The external structural wall section 285 covers the external portion of a corner section where two horizontally adjacent panels 220*a*, 220*b* are joined in a corner. The Insulation layer 286 is also L shaped and lines an inner surface of the external structural wall section 285, to provide insulation properties to the securement anchor 282. The insulation layer 286 is made of rigid insulating material, similarly to the rigid insulating layers 24 of the panels 20. The insulation layer allows a wall having corner sections made using the above described corner securement assembly 280 to have a thermal resistance ranging between about R12 and about R40. For example and without being limitative, in an embodiment, the rigid insulating material can be polystyrene. The insulation layer 286 covers an external surface of the structural core post 287 and is positioned between the external structural wall section 285 and the structural core post 287. The structural core post 287 has a quadrilateral shape and is superposed to the insulation layer 286 to define a securement anchor 282 having an overall quadrilateral shape. The structural core post 287 is also made of rigid material providing sufficient rigidity, compressive strength and/or tensile strength, similarly to the material of the structural inner core 22 of the panels 20. The first and second securement plates 282*a*, 282*b* are joined to adjacent outer surfaces of the structural core post 287, at substantially a 90° vertical angle from one another. The first and second securement plates 282*a*, 282*b* include bracket engagement apertures 284 defined therein and sized and shaped to engage and horizontally lock with corresponding securing brackets 290, as described above. The structural core post 287 includes a vertically extending recess 288 defined therein and positioned rearwardly of the first securement plate 282*a* and the second securement plate 282*b* to define a free space for receiving the engagement section 292 of the corresponding securing brackets 290 and allow rotation thereof.

In view of the above. In the embodiment shown in FIGS. 13 and 14, in order to allow the first and second horizontally adjacent panels 220*a*, 220*b* to be arranged in a corner structure, the above-described need for a section of rigid insulating layer 224 extending longitudinally beyond the inner core 222 and covering the uninsulated portion of the inner core 222 of the first panel 220*a* is alleviated. Indeed, corresponding longitudinal end surface 221 of the inner core 222 of the first panel 220*a* and the second panel 220*b* can be substantially aligned with the corresponding end surface of the insulation layer 224 of the panels 220*a*, 220*b* with the longitudinal end surface 221 of the inner core 222 of the first panel 220*a* and the second panel 220*b* being secured to the corresponding securement plate 282*a*, 282*b* of the securement anchor 282, using securing brackets 290, as described above (i.e. with the securing bracket 290 having its engagement section 292 interlocked with the corresponding securement plate 282*a*, 282*b* of the securement anchor 282 and its fastening section 294 fastened to the inner core 222 of the corresponding one of the first and second horizontally adjacent panels 220*a*, 220*b*. In an embodiment, the first and second securement plates 282*a*, 282*b* of the securement anchor 282 are positioned for a section of the first panel 220*a* and the second panel 220*b* to overlap when joined in the corner configuration.

For ease of description, in the description below, reference to elements in the 10 series will be used to refer to the corresponding features.

In view of the above, the first and second horizontally adjacent panels 20*a*, 20*b*, can be secured in a corner configuration through the steps of initially positioning a securement anchor 82, comprising a first securement plate (or wall) and a second securement plate (or wall) 82*a*, 82*b* between the two horizontally adjacent panels 20*a*, 20*b*. In an embodiment, the method can also include abutting a section of the first securement plate 82*a* with the end surface 21 of the inner core 22 of one of the two horizontally adjacent panels 20*a*, 20*b* and abutting a section of the second securement plate 282*b* with the end surface 21 of the inner core 22 of the other one of the two horizontally adjacent panels 20*a*, 20*b*.

Subsequently, the first and second horizontally adjacent panels 20*a*, 20*b* can be joined by engaging the engagement section 92 of a first securing bracket 90 to the first securement plate 82*a* of the securement anchor 82 and fastening the fastening section 94 of the first securing bracket 90 to the corresponding one of the two horizontally adjacent panels 20*a*, 20*b*, and engaging the engagement section 92 of a second securing bracket 90 to the second securement plate 82*b* of the securement anchor 82 and fastening the fastening section 94 of the first securing bracket 90 to the other one of the two horizontally adjacent panels 20*a*, 20*b*. It will be understood that the above-described steps can be repeated for each vertically engaged panels 20 of a wall 75 used to build the corner section of the wall 75. In an embodiment, fastening the fastening section 94 of the first and second securing brackets 90 to the corresponding one of the two horizontally adjacent panels 20*a*, 20*b*, can be performed by fastening the fastening section 94 of the first and second securing brackets 90 to the inner core 22 thereof.

Using the above-described corner securement assembly 80 and corresponding corner securement method, multiple vertically adjacent panels 20 forming a wall section 75 can each be secured to corresponding ones of multiple vertically adjacent panels 20 forming a horizontally adjacent wall section 75, each panel 20 being secured to a horizontally adjacent panel, as described above, in order to join two walls in a corner structure.

Figure 16:
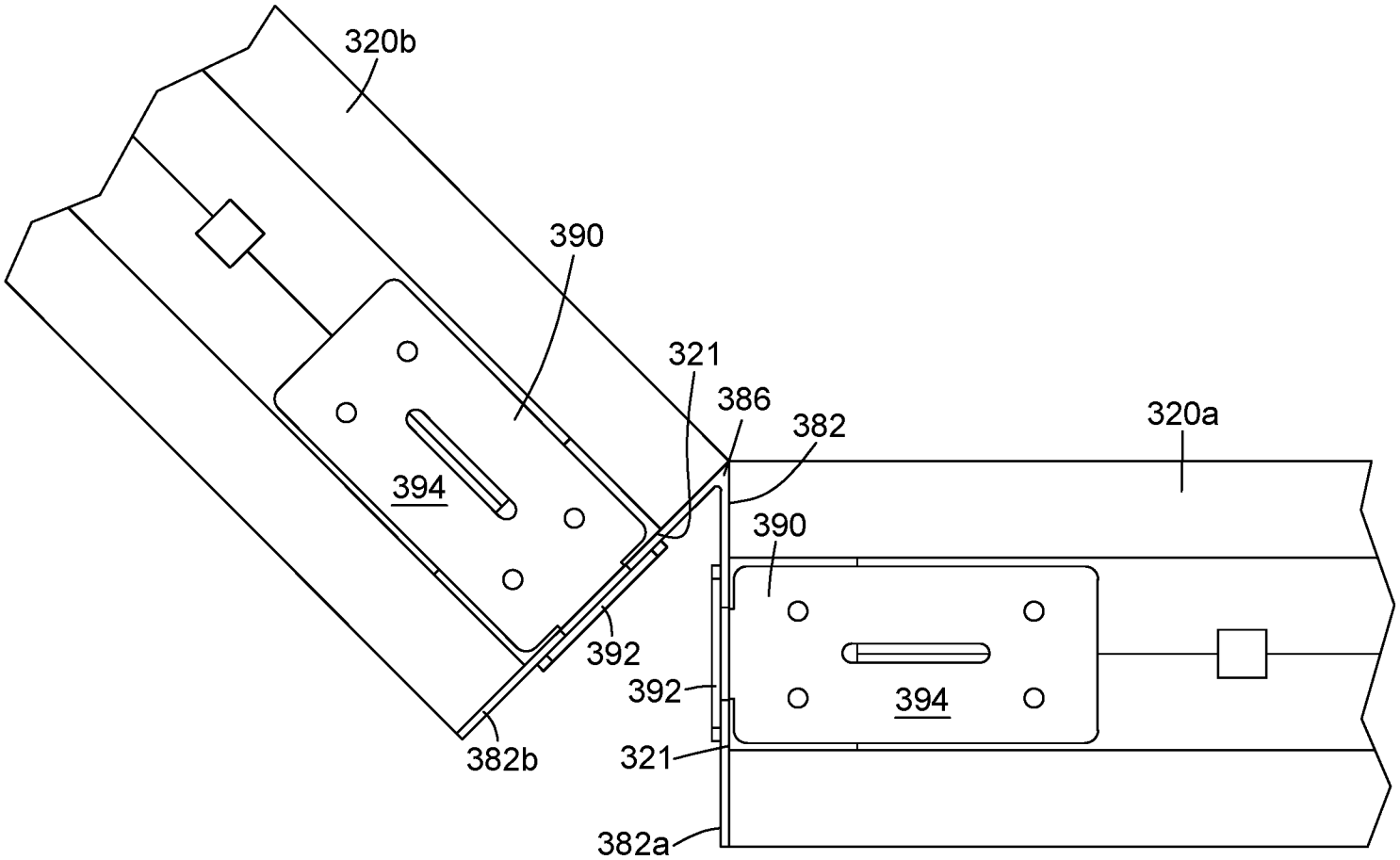
FIG. 16 is a top perspective view of two horizontally adjacent structural panels arranged in an obtuse angle corner configuration and secured using a corner securement assembly including an adjustable securement anchor, in accordance with an alternative embodiment.
Figure 17:
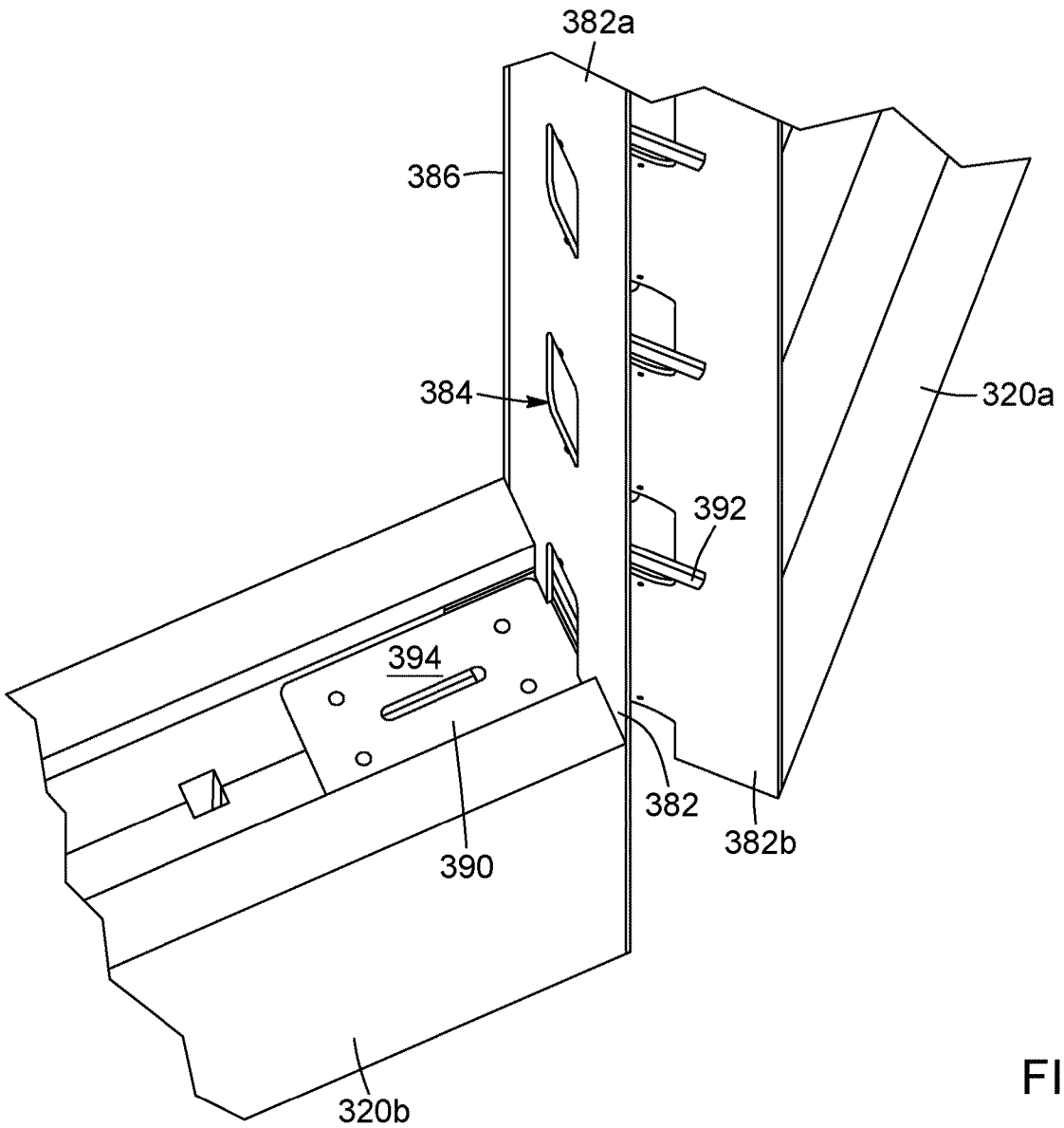
FIG. 17 is a close-up perspective view of a corner section of a structural panel assembly and a building wall built using a plurality of panels, arranged in the obtuse angle corner configuration and secured using the corner securement assembly including the adjustable securement anchor.

Now referring to FIGS. 16 and 17, there is shown another alternative embodiment of the corner securement assembly 80, wherein similar features are numbered using the same reference numerals in the 300 series. In the alternative embodiment, the corner securement assembly 380 can be configured to allow securement of two horizontally adjacent panels 320*a*, 320*b* (or wall sections 375) in a variable angle configuration.

The corner securement assembly 380 of this alternative embodiment again includes a securement anchor 382 securable to the inner core 322 of the first panel 320*a* and second horizontally adjacent panel 320*b*. In the embodiment of FIGS. 16 and 17, the securement anchor 382 has two plates (or wall) 382*a*, 382*b* joined by a hinge 386, thereby allowing the user to adjust the angle between the first panel 320*a* and second panel 320*b* according to the desired corner configuration.

In this alternative embodiment, each one of the plates 382*a*, 382*b* of the securement anchor 382 is engageable to a longitudinal end surface 321 of the inner core 322 of the first and second panels 320*a*, 320*b*, with an empty corner space therebetween.

In the embodiment shown, the bracket engagement apertures 384 of the securement anchor 382 and the securing bracket 390 are once again similar to the previously described embodiments and therefore do not need to be described in more details here. Each securing bracket 390 is also securable to the securement anchor 382 and to the inner core 322 of the corresponding one of the first and second panels 320*a*, 320*b* similarly to the previously described embodiment and therefore do not need to be described in more details here either.

In an alternative embodiment (not shown), the two plates 382*a*, 382*b* of the securement anchor 382 could be affixed to one another at a fixed angle, thereby dictating the angle between the first panel 320*a* and second panel 320*b*. In another alternative embodiment, an insulated securement anchor similar to the one described above, where outer surfaces of the structural core post 287 (and consequently the securement plates 282*a*, 282 joined thereto) are angled at an angle different from the 90° of the embodiment shown can also be provided to allow fixed angle insulated corners different from 90° corners of the embodiment shown in FIGS. 13 and 14.

Several alternative embodiments and examples have been described and illustrated herein. The embodiments of the invention described above are intended to be exemplary only. A person skilled in the art would appreciate the features of the individual embodiments, and the possible combinations and variations of the components. A person skilled in the art would further appreciate that any of the embodiments could be provided in any combination with the other embodiments disclosed herein. It is understood that the invention may be embodied in other specific forms without departing from the central characteristics thereof. The present examples and embodiments, therefore, are to be considered in all respects as illustrative and not restrictive, and the invention is not to be limited to the details given herein. Accordingly, while specific embodiments have been illustrated and described, numerous modifications come to mind without significantly departing from the scope of the invention as defined in the appended claims.

The invention claimed is:

1. A corner securement assembly in combination with a structural panel assembly comprising at least two horizontally adjacent structural panels, the corner securement assembly comprising:

a vertically extending securement anchor comprising:

a structural core post;

a first securement plate and a second securement plate securable to the structural core post and defining a non-zero or non-straight angle inbetween when secured thereto; and a plurality of securing brackets connected to a corresponding one of the first securement plate and the second securement plate of the securement anchor and being configured in a vertically spaced-apart configuration along the corresponding one of the first securement plate and the second securement plate, each one of the securing brackets having a fastening section extending substantially normal to the corresponding one of the first securement plate and the second securement plate and being fastenable to a corresponding one of the at least two horizontally adjacent panels, wherein each one of the at least two horizontally adjacent structural panels comprises a row of vertically-superposed structural panels and the fastening section of each one of the securing brackets is superposable to an upper surface of a corresponding one of the vertically-superposed structural panels.

2. The corner securement assembly of claim 1, wherein the two horizontally adjacent structural panels each have a structural inner core and wherein the fastening section of each one of the securing brackets is securable to the structural inner core of the corresponding one of the at least two horizontally adjacent panels.

3. The corner securement assembly of claim 1, wherein the first securement plate and the second securement plate are mounted to adjacent outer surfaces of the structural core post.

4. The corner securement assembly of claim 1, wherein the securement anchor further comprises an external structural wall section and wherein the securement anchor further comprises an insulation layer covering an external surface of the structural core post, the insulation layer being positioned between the external structural wall section and the structural core post.

5. The corner securement assembly of claim 1, wherein the first securement plate and the second securement plate are oriented to define a vertical angle of about 90° therebetween.

6. The corner securement assembly of claim 1, wherein the structural core post comprises vertically-extending outer surfaces defining an oblique angle inbetween, with each one of the first securement plate and the second securement plate being mounted to a respective one of the outer surfaces of the structural core post and extending vertically therealong.

7. The corner securement assembly of claim 1, wherein the at least two horizontally adjacent structural panels define an oblique angle inbetween.

8. The corner securement assembly of claim 1, wherein each securing bracket has an engagement section interlockable to the corresponding one of the first securement plate and the second securement plate and wherein each one of the first securement plate and the second securement plate of the securement anchor comprises at least one bracket engagement aperture, the engagement section of each securing bracket being sized and shaped to be at least partially insertable through a corresponding bracket engagement aperture when the securing bracket is oriented in an insertion orientation and at least partially prevented from moving through the corresponding bracket engagement aperture when the securing bracket is oriented in an interlocked orientation.

9. The corner securement assembly of claim 8, wherein the engagement section of each securing bracket comprises lateral flanges insertable through the corresponding bracket engagement aperture when the securing bracket is oriented in the insertion orientation and prevented from moving through the corresponding bracket engagement aperture when the securing bracket is oriented in the interlocked orientation.

10. The corner securement assembly of claim 8, wherein the structural core post comprises vertically extending recesses defined therein and positioned rearwardly of the first securement plate and the second securement plate to define a free space for receiving the engagement section of the corresponding securing brackets.

11. A corner securement assembly in combination with a structural panel assembly comprising at least two horizontally adjacent structural panels, the corner securement assembly comprising:

a vertically extending securement anchor comprising:

a structural core post;

a first securement plate and a second securement plate securable to the structural core post and defining a non-zero or non-straight angle inbetween when secured thereto;

a hinge joining the first securement plate and the second securement plate together; and a plurality of securing brackets connected to a corresponding one of the first securement plate and the second securement plate of the securement anchor and being configured in a vertically spaced-apart configuration along the corresponding one of the first securement plate and the second securement plate, each one of the securing brackets having a fastening section extending substantially normal to the corresponding one of the first securement plate and the second securement plate and being fastenable to a corresponding one of the at least two horizontally adjacent panels.

12. The corner securement assembly of claim 11, wherein the two horizontally adjacent structural panels each have a structural inner core and wherein the fastening section of each one of the securing brackets is securable to the structural inner core of the corresponding one of the at least two horizontally adjacent panels.

13. The corner securement assembly of claim 11, wherein the first securement plate and the second securement plate are mounted to adjacent outer surfaces of the structural core post.

14. The corner securement assembly of claim 11, wherein the structural core post comprises vertically extending recesses defined therein and positioned rearwardly of the first securement plate and the second securement plate to define a free space for receiving the engagement section of the corresponding securing brackets.

15. The corner securement assembly of claim 11, wherein the securement anchor further comprises an external structural wall section and wherein the securement anchor further comprises an insulation layer covering an external surface of the structural core post, the insulation layer being positioned between the external structural wall section and the structural core post.

16. The corner securement assembly of claim 11, wherein the first securement plate and the second securement plate are oriented to define a vertical angle of about 900 therebetween.

17. The corner securement assembly of claim 11, wherein the structural core post comprises vertically-extending outer surfaces defining an oblique angle inbetween, with each one of the first securement plate and the second securement plate being mounted to a respective one of the outer surfaces of the structural core post and extending vertically therealong.

18. The corner securement assembly of claim 11, wherein the at least two horizontally adjacent structural panels define an oblique angle inbetween.

19. The corner securement assembly of claim 11, wherein each securing bracket has an engagement section interlockable to the corresponding one of the first securement plate and the second securement plate and wherein each one of the first securement plate and the second securement plate of the securement anchor comprises at least one bracket engagement aperture, the engagement section of each securing bracket being sized and shaped to be at least partially insertable through a corresponding bracket engagement aperture when the securing bracket is oriented in an insertion orientation and at least partially prevented from moving through the corresponding bracket engagement aperture when the securing bracket is oriented in an interlocked orientation.

20. The corner securement assembly of claim 19, wherein the engagement section of each securing bracket comprises lateral flanges insertable through the corresponding bracket engagement aperture when the securing bracket is oriented in the insertion orientation and prevented from moving through the corresponding bracket engagement aperture when the securing bracket is oriented in the interlocked orientation.

* * * * *